US010495281B2

(12) United States Patent
Yamazumi et al.

(10) Patent No.: US 10,495,281 B2
(45) Date of Patent: Dec. 3, 2019

(54) PROJECTION OPTICAL INSTRUMENT AND HEADLIGHT DEVICE

(71) Applicant: MITSUBISHI ELECTRIC CORPORATION, Tokyo (JP)

(72) Inventors: Mitsuhiro Yamazumi, Tokyo (JP); Atsushi Michimori, Tokyo (JP); Eiji Yokoyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 98 days.

(21) Appl. No.: 15/757,907

(22) PCT Filed: Nov. 4, 2016

(86) PCT No.: PCT/JP2016/082856
§ 371 (c)(1),
(2) Date: Mar. 6, 2018

(87) PCT Pub. No.: WO2017/082177
PCT Pub. Date: May 18, 2017

(65) Prior Publication Data

US 2019/0301700 A1 Oct. 3, 2019

(30) Foreign Application Priority Data

Nov. 9, 2015 (JP) ..... 2015-219229

(51) Int. Cl.
*F21S 41/00* (2018.01)
*F21S 41/657* (2018.01)
(Continued)

(52) U.S. Cl.
CPC ..... *F21S 41/657* (2018.01); *F21S 41/32* (2018.01); *F21V 29/67* (2015.01)

(58) Field of Classification Search
CPC ..... B60Q 1/045; B60Q 1/06; B60Q 1/072
See application file for complete search history.

(56) References Cited

U.S. PATENT DOCUMENTS 5,138,540 A 8/1992 Kobayashi et al.
5,911,502 A * 6/1999 Zillgitt ..... F21S 41/657 362/508
(Continued)

FOREIGN PATENT DOCUMENTS

JP 2010-86815 A 4/2010
JP 2011-180210 A 9/2011
(Continued)

*Primary Examiner* — Gerald J Sufleta, II
(74) *Attorney, Agent, or Firm* — Birch, Stewart, Kolasch & Birch, LLP

(57) ABSTRACT

A projection optical instrument includes a light source unit, a projection optical member and a support part. The light source unit emits light. The projection optical member transforms the light emitted from the light source unit into projection light. The support part supports the projection optical member to be movable with respect to the light source unit in at least one direction orthogonal to an optical axis direction of the light source unit. When vibration is applied to at least one of the light source unit and the projection optical member, the projection optical member accordingly vibrates with respect to the light source unit in a direction orthogonal to the optical axis direction of the light source unit.

10 Claims, 10 Drawing Sheets

(51) Int. Cl.
*F21S 41/32* (2018.01)
*F21V 29/67* (2015.01)

(56) References Cited

U.S. PATENT DOCUMENTS

| | | | | |
|---|---|---|---|---|
| 2005/0201116 | A1* | 9/2005 | Browne | F21S 41/333 362/509 |
| 2005/0213340 | A1* | 9/2005 | Suzuki | F21S 41/689 362/538 |
| 2008/0219302 | A1 | 9/2008 | Nakayama et al. | |
| 2010/0195336 | A1* | 8/2010 | Hashemi | F21V 14/00 362/324 |
| 2012/0327679 | A1* | 12/2012 | Takahashi | F21S 41/14 362/538 |
| 2015/0176795 | A1* | 6/2015 | Kikuchi | B60Q 1/076 362/523 |
| 2016/0182869 | A1 | 6/2016 | Fukano | |
| 2016/0339834 | A1* | 11/2016 | Oshima | F21S 41/29 |
| 2017/0129390 | A1* | 5/2017 | Akaza | B60Q 1/115 |

FOREIGN PATENT DOCUMENTS

| | | | |
|---|---|---|---|
| JP | 5225715 | B2 | 7/2013 |
| JP | 2014-32934 | A | 2/2014 |
| JP | 2016-118653 | A | 6/2016 |
| WO | WO 2009/057605 | A1 | 5/2009 |

* cited by examiner

PROJECTION OPTICAL INSTRUMENT AND HEADLIGHT DEVICE

TECHNICAL FIELD

The present invention relates to a projection optical instrument for projecting light and to a headlight device including the projection optical instrument.

BACKGROUND ART

Conventionally, there has been proposed a technology of oscillating (vibrating) a projection optical member such as an optical lens or a fluorescent body in a projection optical instrument and thereby preventing a particular region of the projection optical member from being continuously irradiated with a condensed light flux emitted from a light source unit (see Patent References 1 to 3, for example).

The Patent Reference 1 describes a technology of oscillating a lens with a vibration generator to vary the relative positions of a color wheel and an optical axis of the blue light from a blue light source and thus preventing a particular region of a fluorescent material layer applied on the color wheel from being irradiated with the blue light. The Patent Reference 1 also mentions that a linear actuator can be employed as the vibration generator.

The Patent Reference 2 describes a technology of moving a movable lens with a lens drive mechanism. The lens drive mechanism includes an X-axis drive mechanism unit and a Y-axis drive mechanism unit.

The Patent Reference 3 describes a vibration unit that vibrates at least one of a laser light source unit and a light emission member by using vibration of a vehicle. According to the description, the vibration unit includes an elastic body, which is illustrated as a coil spring in the embodiment and may also be a different type of spring member such as a torsion spring, an elastomer such as rubber, a gel body, a sponge body, or the like. According to the description, the vibration unit also includes a rod and a stopper; the light emission member is a plate-like member substantially in a fan shape; the rod is inserted into a part of the light emission member in the vicinity of the center of the fan shape; the light emission member is rotatably connected to the rod as a rotary shaft; and the light emission member is vibrated around the rod as a shaft by the vibration of the vehicle.

PRIOR ART REFERENCE

Patent Reference

Patent Reference 1: Japanese Patent Application Publication No. 2011-180210

Patent Reference 2: Japanese Examined Utility Model Application Publication No. 8-3922

Patent Reference 3: Japanese Patent Application Publication No. 2014-32934

SUMMARY OF THE INVENTION

Problem to be Solved by the Invention

However, the conventional technologies described above have a problem that the mechanism for vibrating the projection optical member in two axial directions is large-sized or complicated.

The object of the present invention, which has been made to resolve the above-described problem with the conventional technologies, is to provide a projection optical instrument and a headlight device in which the region of the projection optical member which is irradiated with light can be formed like a surface by a simple mechanism.

Means for Solving the Problem

A projection optical instrument according to the present invention comprises a light source unit that emits light, a projection optical member that transforms the light emitted from the light source unit into projection light, and a support part that supports the projection optical member to be movable with respect to the light source unit in at least one direction orthogonal to an optical axis direction of the light source unit. When vibration is applied to at least one of the light source unit and the projection optical member, the projection optical member accordingly vibrates with respect to the light source unit in a direction orthogonal to the optical axis direction of the light source unit.

Effects of the Invention

According to the present invention, the region of the projection optical member which is irradiated with light can be formed like a surface by a simple mechanism.

MODE FOR CARRYING OUT THE INVENTION

Figure 1:
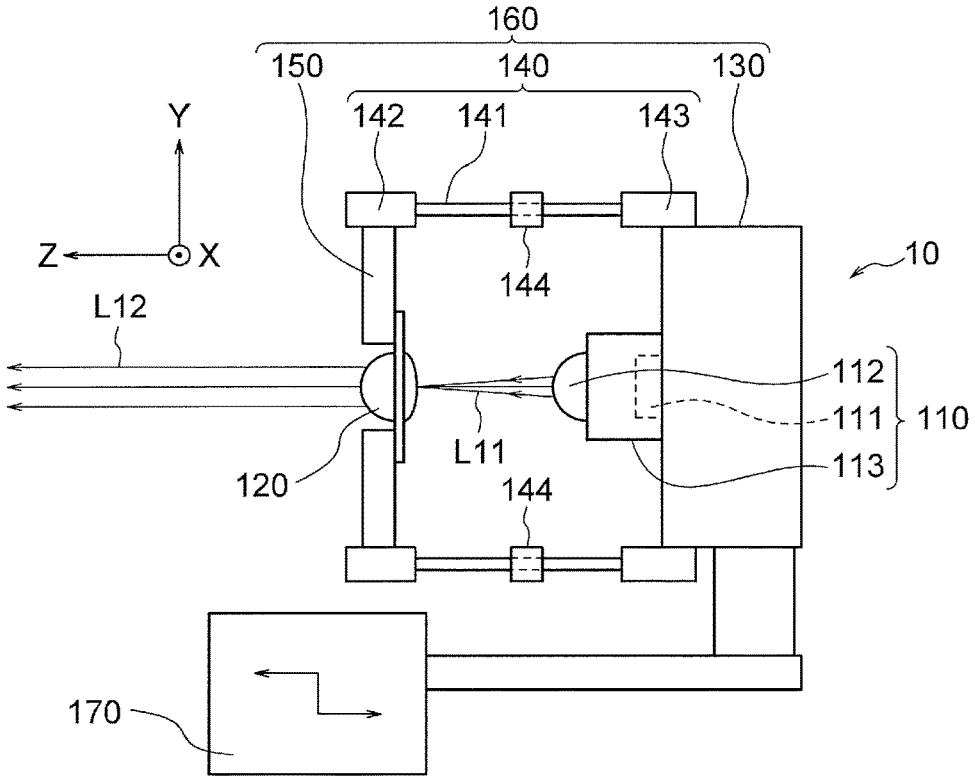
FIG. 1 is a side view schematically showing the configuration of a projection optical instrument according to an embodiment of the present invention.

The present invention provides a projection optical instrument and a headlight device capable of preventing continuous irradiation of a particular region of a projection optical member with light by use of a simple mechanism.

A headlight device for a vehicle according to the present invention can be characterized in including a projection optical instrument described below as an embodiment.

The projection optical instrument includes an instrument that projects light by using optical components and an instrument that simply emits light. That is, the projection optical instrument includes a light source device. To "project" means to cast light.

A preferred embodiment of the present invention will be described below with reference to the drawings. XYZ orthogonal coordinate axes are shown in the drawings. In the following description, the front of the projection optical instrument corresponds to a +Z direction, the back of the projection optical instrument corresponds to a −Z direction, and the projection optical instrument emits projection light in the +Z direction. When facing forward, a leftward direction is a +X direction, a rightward direction is a −X direction, an upward direction is a +Y direction, and a downward direction is a −Y direction.

(1) Embodiment

(1-1) Configuration

Figure 2:
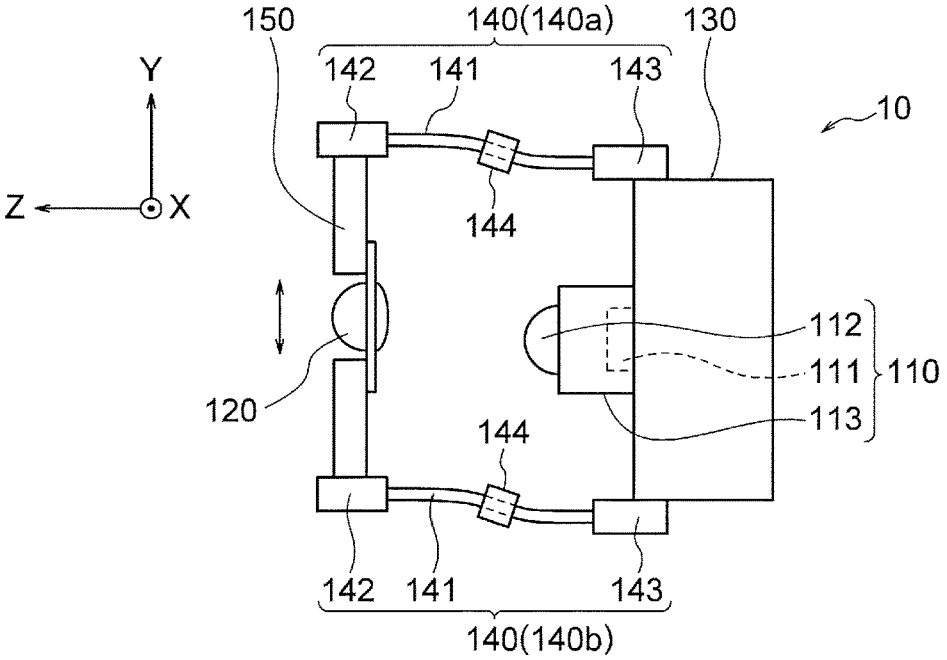
FIG. 2 is a side view schematically showing deformation of bend parts of the projection optical instrument according to the embodiment.
Figure 3:
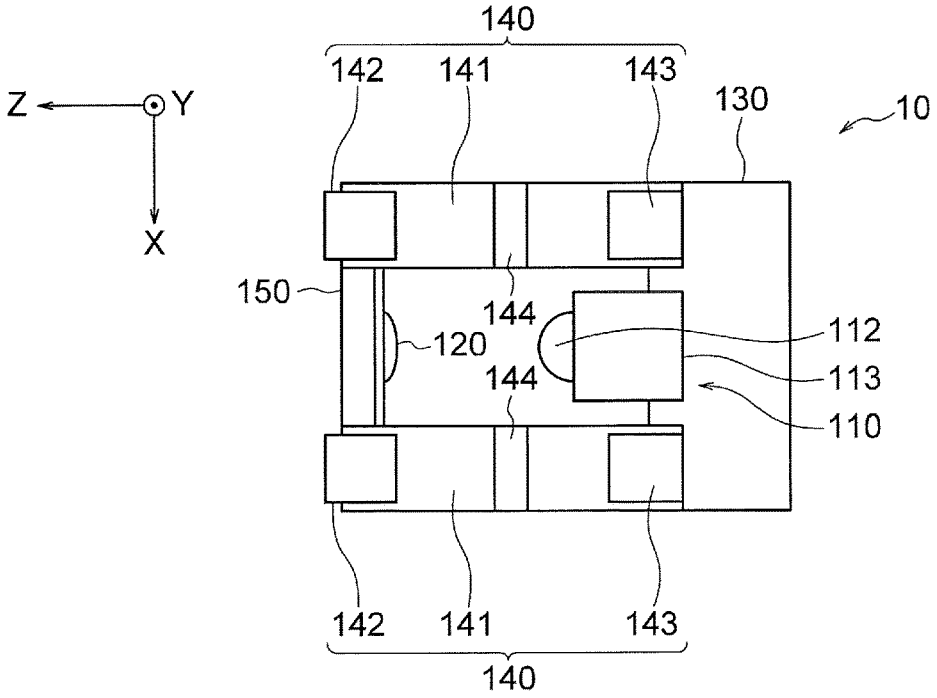
FIG. 3 is a plan view schematically showing the configuration of the projection optical instrument according to the embodiment.

FIG. 1 is a side view schematically showing the configuration of a projection optical instrument 10 according to an embodiment of the present invention. FIG. 2 is a side view schematically showing deformation of bend parts 140 of the projection optical instrument 10 shown in FIG. 1. FIG. 3 is a plan view schematically showing the configuration of the projection optical instrument 10 shown in FIG. 1.

The projection optical instrument 10 is, for example, a headlight device that can be mounted on a vehicle such as an automobile or a motorcycle, or a movable object such as a train, a marine vessel or an airplane. However, the projection optical instrument 10 may also be used as an illumination device mounted on equipment for a purpose other than a vehicle.

While FIG. 1 to FIG. 3 illustrate an example of the configuration of the projection optical instrument 10 according to the embodiment, the shapes, the number and the arrangement of the components of the projection optical instrument 10 are not limited to the example illustrated in FIG. 1 to FIG. 3.

The projection optical instrument 10 includes a light source unit 110 that emits light (incident light) L11, a projection optical member 120 as an optical member that transforms the light L11 emitted from the light source unit 110 into projection light (outgoing light) L12, and a support part 160. The projection optical instrument 10 can further include a hold member 150 holding the projection optical member 120, a housing 130, and a vibration application unit 170.

The support part 160 supports the projection optical member 120 to be movable with respect to the light source unit 110 in at least one direction orthogonal to an optical axis direction of the light source unit 110 (Z-axis direction). In other words, the support part 160 is capable of displacing the projection optical member 120 in at least one direction in a plane parallel to the XY plane. Put another way, the support part 160 is capable of displacing the projection optical member 120 relative to the light source unit 110 in at least one direction orthogonal to the optical axis direction (Z-axis direction).

The vibration application unit 170 applies vibration to at least one of the light source unit 110 and the projection optical member 120. The vibration application unit 170 is capable of applying vibration to both the light source unit 110 and the projection optical member 120. In the example of FIG. 1, the vibration application unit 170 applies vibration to the light source unit 110 via the housing 130. The vibration applied to the housing 130 is transmitted to the projection optical member 120 by the support part 160.

Incidentally, the "at least one of the light source unit 110 and the projection optical member 120" can mean, for example, any one of the following three cases (1) to (3): (1) the light source unit 110 alone, (2) the projection optical member 120 alone, and (3) both the light source unit 110 and the projection optical member 120.

The light L11 emitted from the light source unit 110 is incident on the projection optical member 120. The projection optical member 120 is, for example, a lens that refracts, reflects or transmits the light L11, a fluorescent body that emits light in response to the incident light L11, or a combination of a lens and a fluorescent body. In short, the projection optical member 120 is a lens, a fluorescent body or the like. Moreover, the projection optical member 120 may be a combination of a lens and a fluorescent body.

As shown in FIG. 1, the support part 160 includes the bend parts 140 as connection parts connecting the light source unit 110 and the projection optical member 120. In FIG. 1, the light source unit 110 and the projection optical member 120 are connected to each other by the bend parts 140 via the hold member 150 and the housing 130. The support part 160 can include the hold member (holder) 150 as a second support member by which the projection optical member 120 is supported and the housing 130 as a first support member by which the light source unit 110 is supported.

The bend part 140 can include a fixation member 142 and a fixation member 143. An end of the bend part 140 is fixed to the hold member 150 by the fixation member 142. The other end of the bend part 140 is fixed to the housing 130 by the fixation member 143.

Moreover, the bend part 140 may also be a member having a configuration directly connecting the light source unit 110 and the projection optical member 120 without using the hold member 150 and the housing 130.

In a case where the bend part 140 does not include the fixation members 142, 143 and a resonance point adjustment member 144 in FIG. 1, for example, the bend part 140 is equivalent to a leaf spring 141.

The bend part 140 includes an elastic member whose lengthwise direction coincides with the optical axis direction (Z-axis direction). For example, the bend part 140 may include the leaf spring 141 whose long sides extend in the optical axis direction, short sides extend in the X-axis direction, and thickness direction coincides with the Y-axis direction.

Further, as shown in FIG. 1, the bend part 140 may further include the resonance point adjustment member 144 as a weight attached to the leaf spring 141.

In the example shown in FIG. 1 to FIG. 3, the support part 160 supports the projection optical member 120 to be movable with respect to the light source unit 110 in a first direction (Y-axis direction) orthogonal to the optical axis direction (Z-axis direction). The leaf spring 141 is capable of curving (bending) in its thickness direction. The leaf spring 141 is hardly capable of curving (bending) in its width direction.

Thus, by employing, as the bend part 140, one or more leaf springs 141 whose thickness direction coincides with the Y-axis direction and whose width direction coincides with the X-axis direction, the projection optical instrument 10 is enabled to have the light irradiation position of the projection optical member 120 vibrated (or displaced) in the Y-axis direction and to limit (restrict) the movement of the light irradiation position of the projection optical member 120 in the X-axis direction to values close to zero, for example.

The light source unit 110 includes a light emission source 111 that emits light (incident light) L11 towards the projection optical member 120, for example. The light source unit 110 can include a light source unit optical member 112 such as an optical lens and a light source unit housing 113 that houses these components.

The light emission source 111 can be, for example, one of an LED (Light-Emitting Diode), a xenon lamp, a halogen lamp, an electroluminescence device, a semiconductor laser and the like.

The light source unit optical member 112 refracts, reflects, or refracts and reflects the light emitted from the light emission source 111 and thereby transforms the light into the light L11. The light source unit optical member 112 can be a member that collimates, condenses, or shapes the light emitted from the light emission source 111, for example. The light source unit optical member 112 can either be a single optical element or a set of a plurality of optical elements. Specifically, the light source unit optical member 112 can include a lens, a prism, a reflector, a light guide member, or the like, for example. Since the light emission source 111 generates heat, the light source unit 110 may be provided with a heat radiation structure (e.g., heat radiation plate) for efficiently releasing the heat to the outside.

The light source unit housing 113 holds the light emission source 111 and the light source unit optical member 112, for example. The light source unit housing 113 is attached to the housing 130, for example.

The projection optical member 120 includes one or more optical elements. The one or more optical elements constituting the projection optical member 120 are, for example, a lens, a light guide member, a combination of a lens and a light guide member, or the like. The projection optical member 120 may include a member like a shade (e.g., lamp shade) or a reflector (e.g., reflecting mirror) instead of the aforementioned optical elements or in addition to the aforementioned optical elements. The projection optical member 120 may further include one or both of a transparent material that transmits the incident light L11 and a fluorescent body that emits light in response to irradiation with excitation light.

The hold member 150 is fastened to the projection optical member 120 with a screw or the like, for example, in the example shown in FIG. 1 to FIG. 3. Put another way, the projection optical member 120 is held by fastening it to the hold member 150 with the screw or the like, for example. It is also possible to use a different holding method for the holding of the projection optical member 120 by the hold member 150, such as adhesion with an adhesive agent or pressing with a spring.

In the example shown in FIG. 1, the hold member 150 is held by two or more bend parts 140 (e.g., bend parts 140*a* and 140*b*) arranged in parallel. Incidentally, a bend part 140 situated on a +Y side (or a +X side) will be represented by a reference character 140*a* and a bend part 140 situated on a −Y side (or a −X side) will be represented by a reference character 140*b* as needed.

The hold member 150 is connected to an end on the +Z-axis side of the bend part 140*a* and an end on the +Z-axis side of the bend part 140*b*.

The bend parts 140*a* and 140*b* have leaf springs arranged in parallel with each other, and these leaf springs exhibit behavior as parallel springs. Namely, the hold member 150 is movable in the direction of the arrangement of the bend part 140*a*, the hold member 150 and the bend part 140*b* (Y-axis direction in FIG. 1). The hold member 150 may be provided with a slit or a long projection to secure rigidity.

The bend part 140 has beam structure including the leaf spring 141 in a thin plate shape, the fixation member 142 attached to one end of the leaf spring 141, and the fixation member 143 attached to the other end of the leaf spring 141, for example.

The bend part 140 may include the resonance point adjustment member 144 that adjusts characteristics of the structure so as to vibrate at a particular vibration frequency (e.g., eigenfrequency).

The shapes, materials, positions and so on of the leaf spring 141 and the resonance point adjustment member 144 are designed so as to make the bend part 140 have a resonance point in the same frequency range as, or in a frequency range close to, the frequency of the vibration applied by the vibration application unit 170 when the bend part 140 is fixed to the hold member 150 and the housing 130.

The resonance point adjustment member 144 is desired to have a function capable of adjusting the resonance frequency range of the bend part 140 by changing one or both of the position and the shape. Incidentally, structural characteristics and vibrational characteristics of the leaf springs 141 arranged in parallel can be adjusted to achieve a desired function within an extent not impairing the function of parallel springs and not affecting the outer dimensions of the projection optical instrument 10.

The fixation members 142 and 143 are attached to the ends of the bend part 140. The fixation member 142 is attached to the end on the +Z-axis side of the bend part 140. The fixation member 143 is attached to the end on the −Z axis side of the bend part 140. The fixation member 142 is connected to the hold member 150, for example. The fixation member 142 can be connected to the projection optical member 120, for example. The fixation member 143 is connected to the housing 130, for example.

The vibration application unit 170 applies vibration to one of the bend part 140, the light source unit 110 and the projection optical member 120 via the hold member 150, the housing 130 or the like, or directly, for example. The vibration application unit 170 is a device (e.g., vibrator) that generates vibration for oscillating (vibrating) the hold member 150 and the projection optical member 120.

For example, a vibrator including a motor that rotates a rotary shaft while a weight with a deviated center of gravity is attached to the rotary shaft of the motor can be used as the vibration application unit 170. The vibrator is of the same principle as vibrators for cellular phones, for example.

The vibration application unit 170 can also be a vibration transmission member that transmits vibration, steadily applied thereto from the outside, to the housing 130. The vibration transmission member is a rod-shaped or plate-shaped connection member or the like, for example.

For example, in a case of the projection optical instrument mounted on a vehicle or the like, the vibration application unit 170 may be a member made of metallic material or the like that transmits the vibration of the automobile engine to the housing 130 or the like. The vibration application unit 170 may also be a device including a piezoelectric element for excitation that vibrates the hold member 150, the bend part 140 or the light source unit 110 by periodically applying external force thereto.

The frequency of the vibration transmitted from the vibration application unit 170 to at least one of the housing 130, the bend part 140 and the hold member 150 differs from the vibration frequency of the vibration source, in some cases. The vibration source is an automobile engine as an external vibration source, for example. Thus, it is desirable to measure the vibration frequency (or frequency) of the vibration applied by the vibration application unit 170 and appropriately adjust the weight and the position of the resonance point adjustment member 144 on the basis of the result of the measurement.

In FIG. 1, the housing 130 holds the light source unit 110. Further, the housing 130 holds the projection optical member 120 via the support part 160. The vibration application unit 170 is connected to the housing 130 in FIG. 1. Thus, the vibration application unit 170 is capable of transmitting vibration to the housing 130.

The projection optical instrument 10 may further include a measurement unit as a vibration detector that measures a displacement amount of the projection optical member 120 caused by the oscillation (vibration) and a control device (control unit) having a function of a light source control circuit that increases and decreases the light amount of the light L11 emitted from the light source unit 110 to be a light amount (intensity) corresponding to the measured displacement amount. Here, the displacement amount of the projection optical member 120 includes the amplitude and the cycle of the displacement. The measurement unit is shown as a measurement unit 181 in FIG. 4 which will be explained later, for example. The control device is shown as a control device 182 in FIG. 4 which will be explained later, for example. The control device is an example of a control unit that increases and decreases the light amount to be the light amount (intensity) corresponding to the measured displacement amount.

The measurement unit 181 measures the displacement amount of the projection optical member 120 caused by the oscillation (vibration). The measurement unit 181 may include a photodetector that detects part of the light L11 emitted from the light source unit 110 or part of the projection light L12. The photodetector is shown as a photodetector 183 in FIG. 5 which will be explained later, for example. In this case, the control device 182 calculates the displacement amount of the projection optical member 120 on the basis of variation in the output value of the photodetector 183. The control device 182 indirectly measures the displacement amount of the projection optical member 120.

Further, the control device 182 previously estimates a displacement amount of the irradiation position of the projection light L12 emitted from the projection optical member 120 on the basis of the displacement amount of the projection optical member 120. Then, the control device 182 may perform light distribution control by increasing and decreasing the light amount of the light L11 emitted from the light source unit 110 so as to correspond to the estimated displacement amount.

Put another way, the control device 182 previously estimates (or acquires) the displacement amount of the irradiation position of the projection light L12 emitted from the projection optical member 120 on the basis of the displacement amount of the projection optical member 120. Then, the control device 182 estimates the cycle of the displacement on the basis of the estimated displacement amount. Then, the control device 182 may perform light distribution control by periodically increasing and decreasing the light amount of the light L11 emitted from the light source unit 110. The control device 182 may perform the light distribution control by, for example, periodically increasing and decreasing the light amount so as to decrease the light amount for the projection light L12*a* and increase the light amount for the projection light L12*b* in FIG. 4 which will be explained later.

Alternatively, the control device 182 previously estimates (or acquires) the displacement amount of the irradiation position of the projection light L12 emitted from the projection optical member 120 on the basis of the frequency of the vibration transmitted or generated by the vibration application unit 170. Then, the control device 182 may perform light distribution control by increasing and decreasing the light amount of the light L11 emitted from the light source unit 110 so as to correspond to the estimated displacement amount.

Put another way, the control device 182 previously estimates the displacement amount of the irradiation position of the projection light L12 emitted from the projection optical member 120 on the basis of the vibration frequency or frequency of the vibration transmitted or generated by the vibration application unit 170. Then, the control device 182 may estimate the cycle of the displacement on the basis of the estimated displacement amount and perform light distribution control by periodically increasing and decreasing the light amount of the light L11 emitted from the light source unit 110. The control device 182 may perform the light distribution control by, for example, periodically increasing and decreasing the light amount so as to decrease the light amount for the projection light L12*a* and increase the light amount for the projection light L12*b* in FIG. 4 which will be explained later.

(1-2) Operation

The light (incident light) L11 emitted from the light source unit 110 travels in the +Z-axis direction and then enters the projection optical member 120.

Movement (e.g., translational motion) of the projection optical member 120 in the +Z-axis direction is restricted (limited to approximately zero) by the hold member 150. Meanwhile, movement (e.g., translational motion) of the hold member 150 in the X-axis direction is restricted (limited to approximately zero) by the bend parts 140*a* and 140*b*. The projection optical member 120 is movable in the Y-axis direction as shown in FIG. 2. Incidentally, to "restrict" means to limit the movement to an extent that a function cannot be fulfilled.

The hold member 150 and the bend parts 140 are fixed together by fastening with a screw, for example. The hold member 150 and the bend parts 140 are connected together. In this case, movement of the projection optical member 120 in a rotational direction around an axis in the Y-axis direction is restricted (limited to approximately zero). Further, movement of the hold member 150 in a rotational direction around an axis in the X-axis direction is restricted by the bend parts 140*a* and 140*b*.

It is not necessarily needed to configure the projection optical instrument 10 so as to restrict movement in a rotational direction around an axis in the Z-axis direction. However, it is possible to restrict the movement in the rotational direction around the axis in the Z-axis direction by sufficiently widening the width of the leaf springs 141 of the bend parts 140 or by having each of the bend parts 140*a* and 140*b* include a plurality of leaf springs 141 arranged parallel to each other.

The bend parts 140 vibrate at a vibration frequency in the same frequency range as, or in a frequency range close to the frequency of the vibration applied from the vibration application unit 170. In this embodiment, the leaf springs 141 of the bend parts 140 receiving the vibration from the vibration application unit 170 vibrate in the Y-axis direction.

Since the bend parts 140 are restricted by the hold member 150, the bend parts 140 are deformed in a bending primary mode, for example, and the hold member 150 oscillates in the Y-axis direction in conjunction with the leaf springs 141. The displacement amount (amount of movement) of the hold member 150 is determined by the magnitude (amplitude) of the vibration transmitted from the vibration application unit 170 and the structure of the bend parts 140. The projection optical member 120 is desired to oscillate at a constant cycle due to the vibration of the bend parts 140.

In general, it is easy to make a mathematical model in regard to a first structural example (comparative example) in which a coil spring expanding and contracting in a direction orthogonal to the optical axis of the projection optical member 120 is arranged on a plane orthogonal to the optical axis in order to support the oscillating projection optical member 120. The first structural example (comparative example) is employed often because of its simplicity and high degree of freedom in design.

In contrast, in a second structural example (corresponding to this embodiment) in which the projection optical member 120 is supported by using the plurality of leaf springs 141 parallel to each other like the bend parts 140 shown in FIG. 1 to FIG. 3, it is necessary to construct a mathematical model in regard to the structure including the fixation members 142 and 143 and the leaf springs 141.

However, the mathematical model for the second structural example (corresponding to this embodiment) is difficult and no design solution of the leaf springs 141 exists in some cases. Thus, the second structural example (corresponding to this embodiment) has been used only for limited purposes and has not been used for a projection optical member 120 having a large lens surface. In the limited purposes, for example, there is a small-sized projection optical member like a support for an optical pickup of an optical media reading device.

In the first structural example (comparative example), components like the coil spring are arranged on the outer side of the projection optical member 120, and thus correction of the structural characteristics and the vibrational characteristics affects the outer dimensions of the projection optical member 120.

In contrast, in the second structural example (corresponding to this embodiment), the configuration for oscillating the projection optical member 120 can be made small in size. However, such structure like the second structural example (corresponding to this embodiment), in which there is a correlation between the oscillation of the projection optical member 120 and the outer dimensions of the projection optical instrument 10, generally has great technological difficulty in design.

However, the bend parts 140 in this embodiment can be arranged so that their lengthwise direction coincides with the optical axis direction, and thus can be made small in size compared to the conventional structure transmitting vibration via a mechanism like a spring and gear wheels.

Further, the structural characteristics and the vibrational characteristics of the bend parts 140 can be set by the design of the thickness (in the Y-axis direction), the length (in the Z-axis direction), the width (in the X-axis direction) and the like of the leaf spring 141. Accordingly, the second structural example less affects the outer dimensions of the projection optical instrument 10.

In the projection optical instrument 10 according to this embodiment in which the vibration application unit 170 transmits vibration to one of the housing 130, the bend parts 140 and the hold member 150, a drive transmission mechanism can be omitted or simplified compared to a case where vibration is applied via a drive force transmission mechanism such as gear wheels.

Furthermore, the vibration application unit 170 may be set at a distant position as long as the vibration application unit 170 has the structure capable of transmitting vibration to the housing 130, the bend parts 140 and the hold member 150. In other words, in this embodiment, the size of the vibration application unit 170 hardly affects the size of the projection optical instrument 10.

Moreover, since the hold member 150 vibrates periodically due to the vibration of the bend parts 140, the energy of vibration (electric energy) required of the vibration application unit 170 is lower than the energy (electric energy) necessary when the hold member 150 is operated in a static manner. This is because the displacement amount of the housing 130 can be made smaller than the displacement amount of the hold member 150 in a case where the hold member 150 is vibrated.

Since the projection optical instrument 10 according to this embodiment is configured as described above, by restricting the hold member 150 with a plurality of bend parts 140 including parallel springs (e.g., a plurality of leaf springs 141) and vibrating the hold member 150 with the vibration application unit 170, it is possible to arrange the projection optical member 120 with high precision in the optical axis direction (Z-axis direction) and to make the support part 160 for the projection optical member 120 which is movable in at least one direction orthogonal to the optical axis direction (Z-axis direction) have a small-sized structure.

By the oscillation (or displacement) of the projection optical member 120 relative to the light source unit 110, the incident light L11 is applied to different regions of the projection optical member 120 with the elapse of time. Accordingly, the projection light L12 from the projection optical member 120 changes with time in shape and illuminance due to the oscillation of the projection optical member 120.

Figure 4:
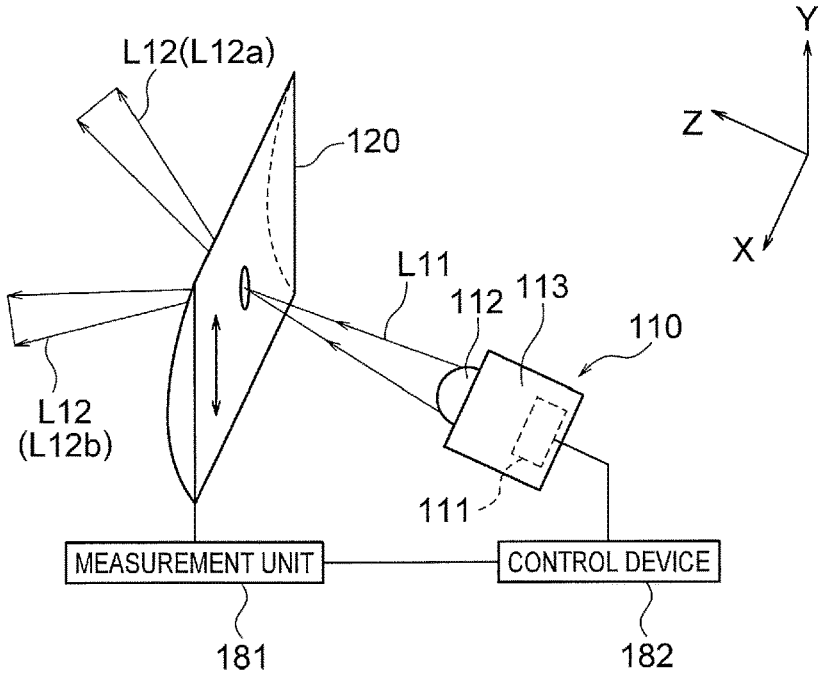
FIG. 4 is a schematic diagram showing an example of the change in the direction of projection light emitted from a projection optical member of the projection optical instrument according to the embodiment.

FIG. 4 is a schematic diagram showing an example of the change in the direction of the projection light L12 emitted from the projection optical member 120 of the projection optical instrument 10 according to this embodiment.

As shown in FIG. 4, the projection optical instrument 10 includes the measurement unit 181 that measures the displacement of the projection optical member 120 and the control device 182 that controls the amount of light emission of the light emission source 111 on the basis of measurement values obtained by the measurement unit 181. The displacement of the projection optical member 120 includes the displacement amount and the cycle of the displacement. The control device 182 controls the amount of light emission of the light emission source 111 by changing drive voltage, for example.

FIG. 4 shows an example of a situation in which the incident light L11 is refracted or reflected by the projection optical member 120 and the direction and the shape of the projection light L12 change.

The shape of the projection light L12 is the same as its shape at each time observed in a case where the projection optical member 120 is fixed and the light source unit 110 is oscillated in the Y-axis direction. For example, when the projection optical member 120 as a projection lens of a headlight device for a vehicle is displaced (or oscillated) in the Y-axis direction, the projection light L12 also shifts in the same direction. Thus, in the case of the vehicle headlight device, oscillating (vibrating) the projection lens as the projection optical member 120 in the Y-axis direction causes the projection light L12 to oscillate in the Y-axis direction.

Here, the light amount of the projection light L12 projected per fixed period can be changed in the Y-axis direction by periodically varying the intensity of the light emitted from the light source unit 110 while oscillating the projection optical member 120.

For example, the cycle of the displacement is estimated on the basis of the displacement amount of the projection optical member 120, the light distribution control is performed by periodically increasing and decreasing the light amount of the light L11 emitted from the light source unit 110, and thereby the projection light L12 can be pointed towards an intended position in the Y-axis direction. For example, in FIG. 4 which will be explained later, the light distribution control is performed by periodically increasing and decreasing the light amount so as to decrease the light amount for the projection light L12*a* and increase the light amount for the projection light L12*b*.

Figure 5:
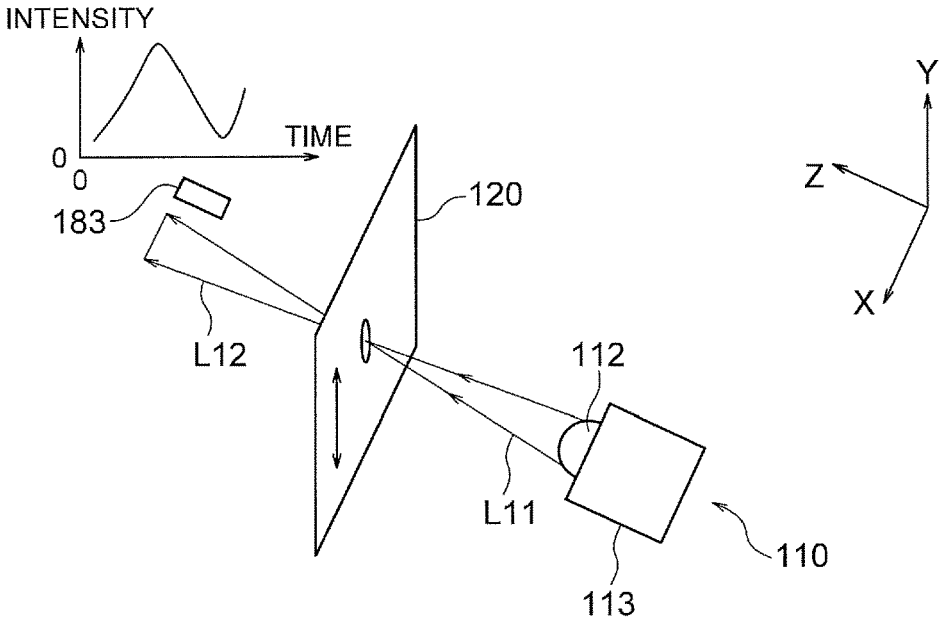
FIG. 5 is a schematic diagram showing an example of the change in the intensity of the projection light emitted from the projection optical member of the projection optical instrument according to the embodiment.

FIG. 5 is a schematic diagram showing an example of the change in the intensity of the projection light L12 emitted from the projection optical member 120 of the projection optical instrument 10 according to this embodiment. FIG. 5 shows a situation in which the incident light L11 is transmitted by the projection optical member 120, or the incident light L11 excites the projection optical member 120 to cause light emission, and consequently, the intensity and optical characteristics of the emitted projection light L12 change.

For example, when there is spatial anisotropy in the transmittance of the projection optical member 120 or the luminous efficiency of the projection optical member 120 (in a case where the projection optical member 120 includes a fluorescent body), the optical characteristics of the projection light L12 vary with time due to the variations in the irradiated region caused by the oscillation of the projection optical member 120. For example, in a case where a projection optical member 120 including a fluorescent body, coated with a plurality of fluorescent paints so that their distributions vary in the Y-axis direction, is translated in the Y-axis direction, the chromaticity of the projection light L12 changes in a certain distribution width due to the oscillation of the projection optical member 120.

Here, by periodically varying the light source unit 110 with respect to the oscillation of the projection optical member 120, the chromaticity of the projection light L12 projected in a fixed period can be limited. Specifically, by increasing and decreasing the output of the light source unit 110, the projection light L12 can be controlled to have an intended chromaticity within a range of change caused by the translational motion of the projection optical member 120 in the Y-axis direction.

Further, the region of the projection optical member 120 irradiated with the incident light L11 enlarges in the Y-axis direction due to the oscillation. In a case where the projection optical member 120 oscillates (vibrates) in the Y-axis direction relative to the light source unit 110, the energy applied by the incident light L11 per unit time is dispersed in the Y-axis direction.

For example, in a case where both the intensity and the shape of the incident light L11 are constant, the heat generation of the projection optical member 120 due to the incident light L11 is dispersed to a large region of the projection optical member 120, and thus a local temperature rise is inhibited. Since the optical characteristics of the projection optical member 120 such as the refractive index and the transmittance or the light emission ratio are influenced by the temperature, the oscillation (vibration) of the projection optical member 120 relative to the light source unit 110 is capable of preventing the local temperature rise of the projection optical member 120 and stabilizing the optical characteristics of the projection light L12.

(1-3) Effect

As described above, with the projection optical instrument 10 according to this embodiment, the shape, the intensity and the optical characteristics of the projection light L12 can be changed or controlled by the oscillation (vibration) of the projection optical member 120 relative to the light source unit 110. As a result, the region of the projection optical member which is irradiated with light can be formed like a surface by a simple mechanism. Accordingly, the characteristics of the projection light L12 can be stabilized.

Further, since the projection optical instrument 10 according to this embodiment employs the support part 160 including the bend parts 140 as the structure for oscillating the projection optical member 120 relative to the light source unit 110 in at least one direction orthogonal to the optical axis direction (Z-axis direction), downsizing and simplification of the configuration are possible.

Furthermore, the projection optical instrument 10 according to this embodiment is capable of controlling the shape, the intensity and the optical characteristics of the projection light L12 in the projection optical instrument 10 and controlling the light distribution of the projection light L12 by periodically controlling the output intensity of the light source unit 110.

Moreover, the projection optical instrument 10 according to this embodiment has the following social significance and advantages:

Projection optical instruments that emit light are being more and more downsized due to the technological innovation of the light source unit employing a semiconductor (semiconductor light source unit) compared to conventional technologies. For example, with the prevalence of LED light source units as the semiconductor light source units, backlights of liquid crystal televisions are being downsized, and the thinning of the liquid crystal televisions is more remarkable compared to CRT televisions.

The use of the semiconductor light source unit as a vehicle headlight device has recently been approved by laws and regulations in Europe, and vehicle headlight devices employing LED light source units are becoming prevalent. With the prevalence of the semiconductor light source units, the vehicle headlight devices are being downsized. In regard to the vehicle headlight devices, new designs such as multiple light designs are being proposed. There is also proposed a light distribution control technology for improving the driver's visibility by moving the light distribution in the up-and-down direction or in the left-and-right direction.

A microminiature device having an imaging function which is typified by a smartphone (e.g., personal digital assistant) is becoming prevalent. A device having the imaging function is carried, and thereby there arises a new demand for displaying images at any time and place and portable projectors are being newly introduced to the market.

The downsizing of the projection optical instruments is creating new senses of value and new concepts as above, and thus the downsizing of the projection optical instruments is significant for the society.

Meanwhile, the projection optical instrument using the projection optical member while oscillating the projection optical member is a technology applicable to a technology for eliminating the scintillation of the laser light source unit in projection-type televisions, for example. The projection-type television employing the laser light source unit has an advantage of greatly exceeding the color gamut of the LED light source unit. However, an oscillating device of such a projection-type television is large-sized compared to that of the thin liquid crystal television. Thus, televisions employing the LED light source unit, having a narrow color gamut compared to the projection-type televisions employing the laser light source unit, are the mainstream under the present situation.

On the other hand, the televisions employing the LED light source unit are considered to be difficult to achieve the ultra high definition/wide color gamut standard images which are being standardized as broadcast waves scheduled for the year 2020. From such a viewpoint, if the oscillating (vibrating) device as the vibration application unit 170 of the projection optical instrument 10 can be downsized, the problem with the color gamut can be resolved by a projection television employing the projection optical instrument 10 as the laser light source unit.

As above, the projection optical instrument 10 according to this embodiment is applicable to vehicle headlight devices, illumination devices, backlights for liquid crystal televisions, projection light source devices for projection televisions, projection light sources for projectors mounted on personal digital assistants or the like, and so forth.

(2) First Modification

(2-1) Configuration

Figure 12:
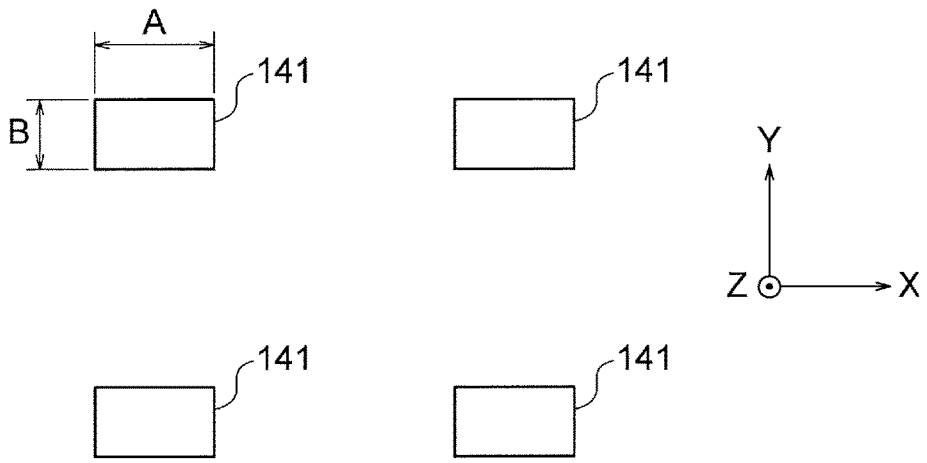
FIG. 12 is a cross-sectional view schematically showing the configuration of springs of a projection optical instrument according to a first modification of the present invention.

FIG. 12 is a cross-sectional view showing the general configuration of springs 141 in a first modification. FIG. 12 shows a diagram of the springs 141 viewed in the optical axis direction (Z-axis direction). FIG. 12 shows cross-sectional shapes and arrangement of the four springs 141 are shown in FIG. 12 since the projection optical instrument 10 shown in FIG. 1 includes the four leaf springs 141.

As shown in FIG. 12, in the first modification, the aforementioned leaf spring 141 is formed in a pillar shape. Thus, in the description of the first modification, it will be simply referred to as the "spring 141". The pillar shape of the spring 141 is long in the optical axis direction of the light source unit 110. Here, the "optical axis direction" represents an optical axis in the optical sense. Thus, when the traveling direction of the light is changed by a mirror or the like, the "optical axis direction" is also changed in the same way.

Figure 6:
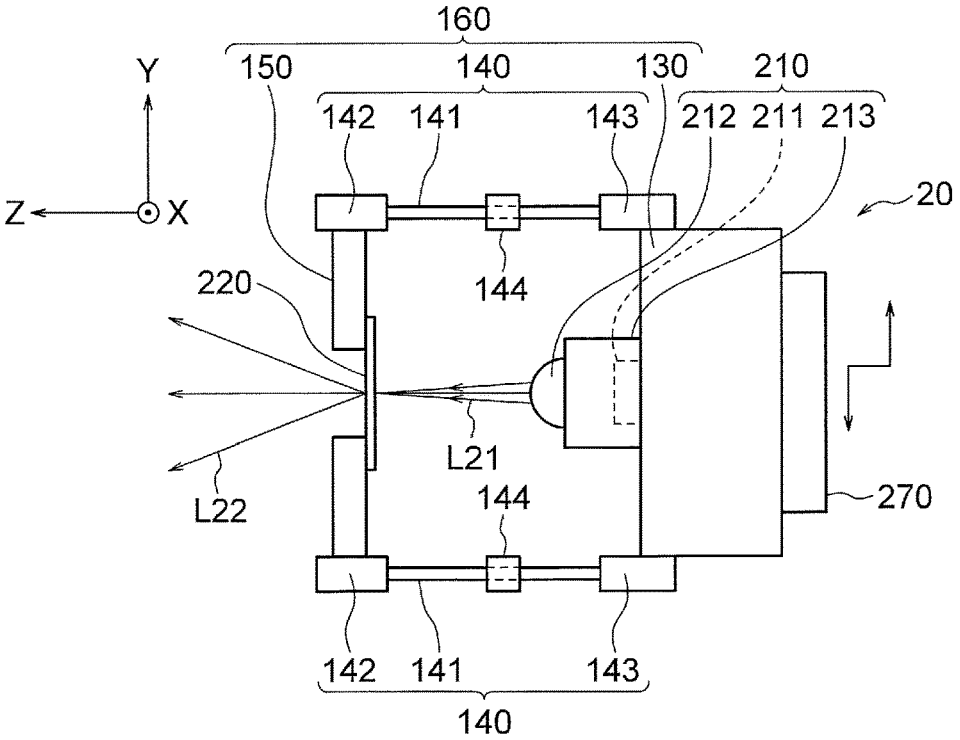
FIG. 6 is a side view schematically showing the configuration of a projection optical instrument according to a second modification of the present invention.

In cases where the bend part 140 does not include the fixation members 142, 143 and the resonance point adjustment member 144 in FIG. 1 or FIG. 6, for example, the bend part 140 is equivalent to the spring 141.

The thickness of the spring 141 in the X-axis direction differs from the thickness of the spring 141 in the Y-axis direction. For example, the thickness A in the X-axis direction and the thickness B in the Y-axis direction satisfy the relationship A>B. The springs 141 are capable of curving (bending) in the X-axis direction and in the Y-axis direction. However, the springs 141 are capable of restricting the position of a projection optical member 220 in the optical axis direction (Z-axis direction).

Figure 13A:
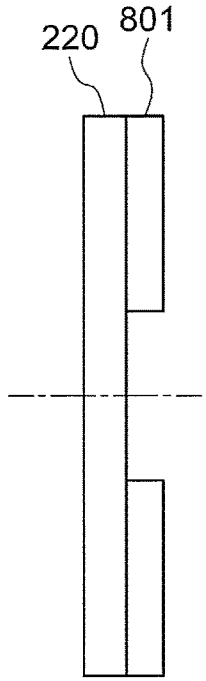
FIG. 13(*a*) and FIG. 13(*b*) are a side view and a front view showing the general configuration of a projection optical member in the first modification.
Figure 13B:
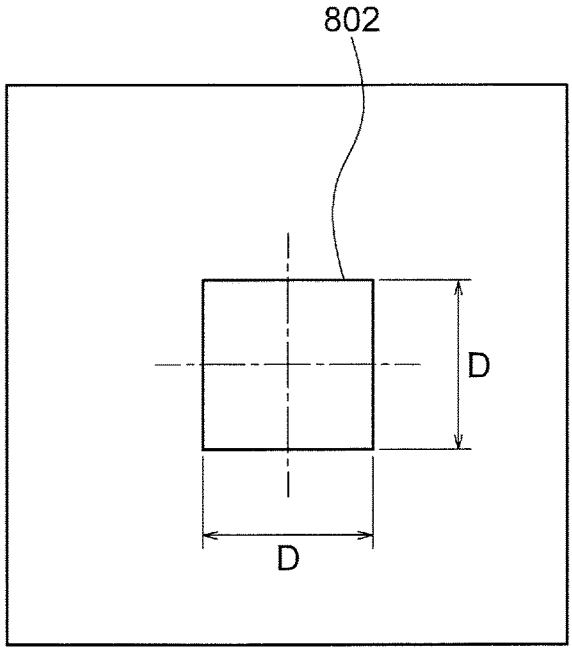

FIG. 13(*a*) and FIG. 13(*b*) are a side view and a front view showing the general configuration of the projection optical member 220 in the first modification. FIG. 13(*a*) shows a diagram the projection optical member 220 viewed in the X-axis direction, while FIG. 13(*b*) shows a diagram the projection optical member 220 viewed in the optical axis direction (Z-axis direction).

As shown in FIG. 13(*a*), a heat radiation plate 801 is attached to the projection optical member 220 in the first modification. The heat radiation plate 801 is an example of a heat radiation part. The heat radiation plate 801 is in close contact with the projection optical member 220, for example. As shown in FIG. 13(*b*), an opening 802 is formed at the center of the heat radiation plate 801.

The heat radiation plate 801 is an example of a heat radiation member that reduces heat generated in the projection optical member 220. The opening 802 is a region (e.g., opening part) through which the light L11 emitted from the light source unit 110 passes. Thus, the opening 802 does not necessarily need to be a hole. It is possible to arrange a member though which the light L11 passes in the opening 802, for example. In short, the opening 802 is a light passage part. Alternatively, the opening 802 is a light transmissive part.

If the springs 141 is considered as beams, a spring constant (first spring constant) kx regarding bending in the X-axis direction as a second direction and a spring constant (second spring constant) ky regarding bending in the Y direction as a first direction differ from each other. Mass of a part supported by the springs 141 is assumed to be m. Here, the mass m is the sum of a mass of the hold member 150 and a mass of the projection optical member 220. In this case, an eigenfrequency ωx in the X-axis direction and an eigenfrequency cry in the Y-axis direction are represented by the following expressions (1):

$$\omega x=(kx/m)^{0.5} \tag{1a}$$

$$\omega y=(ky/m)^{0.5} \tag{1b}$$

When the vibration is transmitted by the vibration application unit 170, the projection optical member 220 vibrates in the X-axis direction and in the Y-axis direction at frequencies different from each other.

Figure 14:
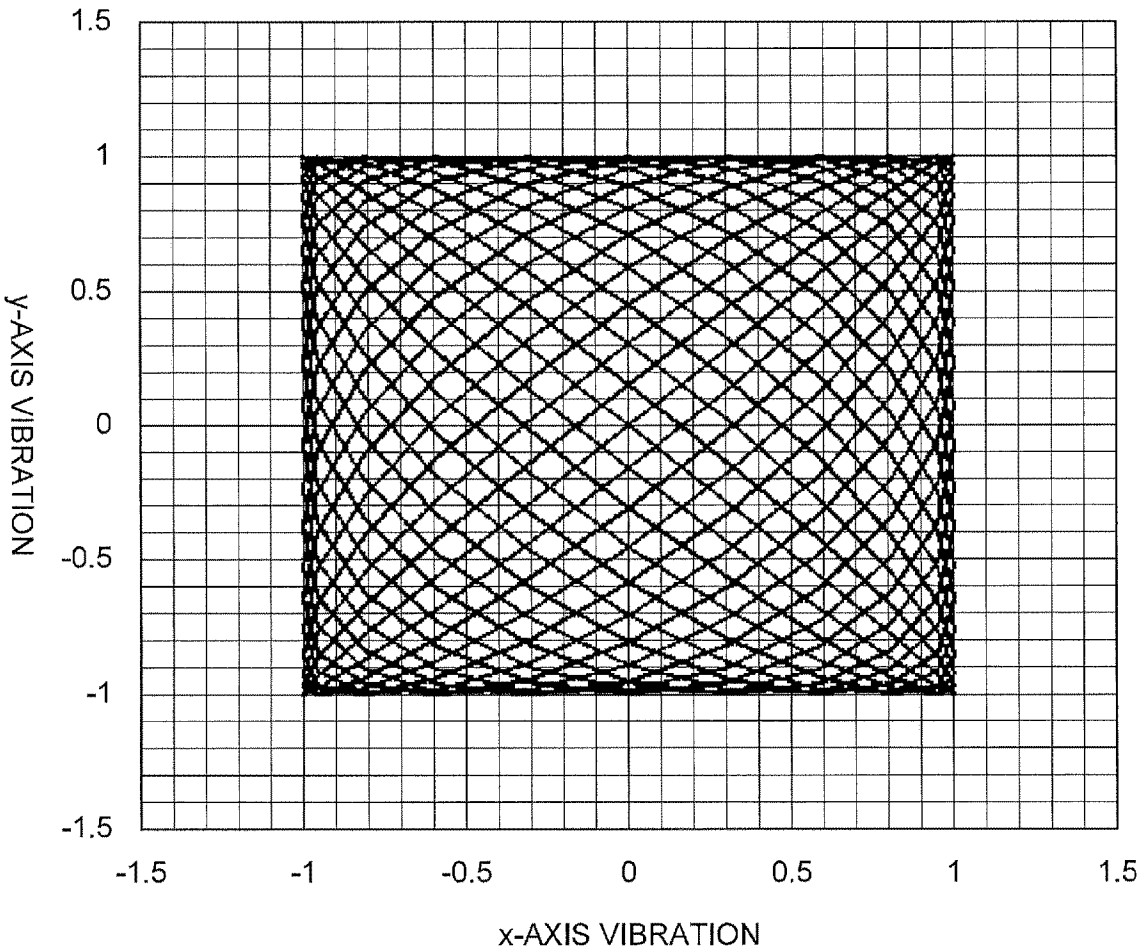
FIG. 14 is a diagram illustrating the position of the projection optical member according to the first modification on an X-Y plane.

FIG. 14 is a diagram illustrating the position of the projection optical member 220 on an X-Y plane in the first modification.

The position of the projection optical member 220 on the X-Y plane varying due to the vibration forms cycloid curves like those shown in FIG. 14. The cycloid curves shown in FIG. 14 are equivalent to the position of the incident light L11 incident on the projection optical member 220.

Accordingly, the incident light L11 is prevented from intensively irradiating a particular region of the projection optical member 220. The incident light L11 irradiates the projection optical member 220 while being dispersed to a large region of the projection optical member 220. In other words, the local temperature rise on the projection optical member 220 is inhibited.

Figure 15:
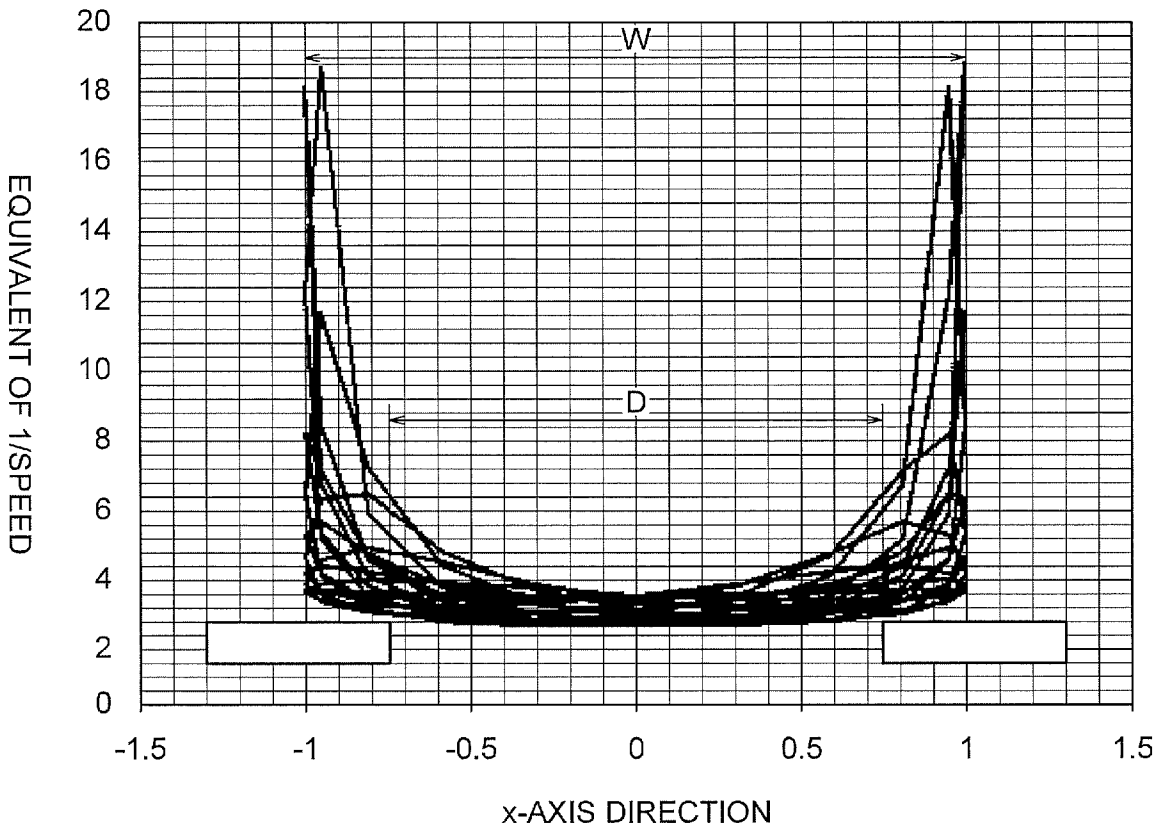
FIG. 15 is a diagram showing the degree of concentration of heat on the projection optical member according to the first modification.

FIG. 15 is a diagram showing the degree of concentration of heat on the projection optical member 220 in the first modification. The horizontal axis of FIG. 15 represents the X-axis direction position (mm) on the projection optical member 220. The vertical axis of FIG. 15 represents the inverse number of speed of the incident light L11.

Namely, the vertical axis of FIG. 15 represents the time for which the incident light L11 remains at each position represented by the horizontal axis of FIG. 15. Since the temperature rise of the projection optical member 220 is proportional to the time for which the incident light L11 remains, the vertical axis of FIG. 15 represents the degree of concentration of heat on the projection optical member 220 at each position represented by the horizontal axis of FIG. 15.

The concentration of heat on the projection optical member 220 is caused by a drop in the speed of the incident light L11. Therefore, a size D of the opening 802 (a length D in FIG. 13(*b*)) is set smaller than the width W of the vibration of the incident light L11. With this configuration, the heat radiation plate 801 can effectively perform the heat radiation from the part where the heat concentrates on the projection optical member 220.

(2-2) Effect

In the projection optical instrument 10 according to the first modification, the springs 141 in pillar shapes are included and the spring constant kx of the springs 141 regarding the bending in the X-axis direction and the spring constant ky of the springs 141 regarding the bending in the Y direction differ from each other. With this configuration, the position of the projection optical member 220 on the X-Y plane varying due to the vibration forms cycloid curves, for example. Accordingly, the incident light L11 irradiates the projection optical member 220 while being dispersed to a large region of the projection optical member 220. Thus, the degree of intensive irradiation of a particular region of the projection optical member 220 with the incident light L11 is reduced. Consequently, the local temperature rise on the projection optical member 220 can be inhibited.

(3) Second Modification (3-1) Configuration

FIG. 6 is a side view schematically showing the configuration of a projection optical instrument 20 according to a second modification of the present invention.

In FIG. 6, components identical or corresponding to those shown in FIG. 1 are assigned the same reference characters as in FIG. 1.

The projection optical instrument 20 is, for example, a headlight device that can be mounted on a vehicle such as an automobile or a motorcycle. Alternatively, the projection optical instrument 20 is, for example, a headlight device that can be mounted on a movable object such as a train, a marine vessel or an airplane.

The projection optical instrument 20 according to the second modification differs from the projection optical instrument 10 in a light source unit 210 as a semiconductor light source unit, a projection optical member 220 as a light emission member, and a vibration application unit 270 provided on the housing 130. Except these features, the projection optical instrument 20 according to the second modification is equivalent to the projection optical instrument 10. The projection optical instrument 20 according to the second modification may include the measurement unit 181 or the photodetector 183 shown in FIG. 4 and FIG. 5 and the control device 182 that controls the amount of light emission of the light emission source.

As shown in FIG. 6, the projection optical instrument 20 according to the second modification includes the light source unit 210 as a condensing light source unit that emits condensed light, the projection optical member 220 that emits light in response to excitation by light (incident light) L21 emitted from the light source unit 210, and the support part 160. The support part 160 includes the bend parts 140. The projection optical instrument 20 can include the hold member 150 holding the projection optical member 220, the housing 130, and the vibration application unit 270. The vibration application unit 270 is identical with the vibration application unit 170 except for its attaching position.

The light source unit 210 includes a light emission source 211 as a semiconductor light source, for example. The light source unit 210 can include a light source unit optical member 212 such as a lens and a light source unit housing 213 that houses these components. Since the light source unit 210 generates heat, the light source unit 210 is desired to be provided with a heat radiator (e.g., heat radiation plate) for releasing the heat generated in the light source unit 210 to the outside.

The light source unit optical member 212 condenses light emitted from the light emission source 211.

The light source unit optical member 212 is an optical system which includes one or more optical elements and transforms the light emitted from the light emission source 211 into the condensed incident light L21. The light source unit optical member 212 is, for example, a lens having a collimation surface for transforming the light emitted from the light emission source 211 into collimated light and a condensing surface for condensing the collimated light.

The projection optical member 220 receives the incident light L21 emitted from the light source unit 210, thereby emitting the light. The projection optical member 220 is held by the support part 160. The projection optical member 220 is held at a movable end of the support part 160.

The projection optical member 220 is a member that receives the incident light L21 projected from the light source unit 210 and thereby emits the light as the outgoing light (projection light) L22. The projection optical member 220 is, for example, a member including a fluorescent body. The projection optical member 220 is connected to the fixation members 142 of the bend parts 140 by the hold member 150, for example. The projection optical member 220 is formed by, for example, coating a heat-resistant material that transmits light with a fluorescent paint that emits low coherence light when excited by light.

The vibration application unit 270 is attached to the housing 130. With this configuration, the vibration generated by the vibration application unit 270 is directly transmitted to the housing 130. The housing 130 holds the projection optical member 220 via the support part 160 as explained above. Thus, the vibration transmitted to the housing 130 is transmitted to the projection optical member 220 via the support part 160. The vibration transmitted to the projection optical member 220 is amplified by the support part 160.

(3-2) Operation

The projection optical member 220 is excited by the incident light L21 as light with high energy density condensed by the light source unit 210. The projection optical member 220 emits the light L22 having a wavelength longer than a wavelength of the light L21 emitted from the light emission source 211. The light is projected as the projection light L22 radially, for example.

For example, the light source unit 210 is a light source unit that emits ultraviolet laser light. The projection optical member 220 may be a member including one of a blue light emission fluorescent body that makes wavelength conversion from an ultraviolet ray into blue light, a yellow light emission fluorescent body that makes wavelength conversion from an ultraviolet ray into yellow light, and a red light emission fluorescent body that makes wavelength conversion from an ultraviolet ray into red light, or a member including two or more fluorescent bodies of these fluorescent bodies.

The material of the projection optical member 220 is, for example, transparent inorganic material such as sapphire or glass containing fluorescent material. The material of the projection optical member 220 can also be, for example, light transmissive ceramic, heat-resistant resin or the like containing fluorescent material.

In the second modification, the incident light L21 is light with high energy density condensed by the light source unit 210. In the region of the projection optical member 220 irradiated with the incident light L21, there is a possibility that the temperature rise causes deterioration in characteristics and thermal erosion. Thus, the projection optical member 220 is generally desired to be formed of material having heat resistance.

It is desirable to cool down the vicinity of the light-emitting surface of the projection optical member 220 as needed by means of convection of fluid (e.g., air) or heat transmission by a heat radiation member. Moreover, it is desirable to inhibit an excessive local temperature rise by oscillating the light source unit 210 or the projection optical member 220 to reduce the amount of irradiation of a particular region of the projection optical member 220 with the incident light per unit time.

In the second modification, the light source unit housing 130 is vibrated by the vibration application unit 270 and consequently the projection optical member 220 is oscillated (vibrated) relative to the light source unit 210. Therefore, the region of the projection optical member 220 irradiated with the incident light L21 can be formed as a large region. Accordingly, the local temperature rise on the projection optical member 220 is inhibited.

(3-3) Effect

As described above, with the projection optical instrument 20 according to the second modification, the shape, the intensity and the optical characteristics of the projection light L22 can be changed or controlled by the oscillation (vibration) of the projection optical member 220 relative to the light source unit 210. As a result, an effect of enabling the characteristics of the projection light L22 to be stabilized is obtained.

Further, since the projection optical instrument 20 according to the second modification employs the bend parts 140 that oscillates the projection optical member 220 in at least one direction orthogonal to the optical axis (Z-axis) and a small-sized support member (housing 130) including the vibration application unit 270, downsizing and simplification are possible.

Furthermore, the projection optical instrument 20 according to the second modification is capable of controlling the shape, the intensity and the optical characteristics of the projection light L22 of the projection optical instrument 20 by periodically controlling the output intensity of the light source unit 210. In addition, the projection optical instrument 20 is capable of controlling the light distribution of the projection light L22.

In the second modification, the projection optical member 220 oscillates due to the vibration by the vibration application unit 270. The vibration applied by the vibration application unit 270 can be generated with low energy (electric power). Alternatively, external vibration can be used as the vibration applied by the vibration application unit 270. For example, in a vehicle (movable object) such as an automobile or an electric train, the vibration application unit 270 may transmit the vibration of the vehicle to at least one of the projection optical member 220 and the light source unit 210 as the external vibration. In a case where the vibration application unit 270 using the external vibration of a vehicle or the like is employed, further downsizing of the projection optical instrument 20 is possible.

A means for substituting for energy by using external vibration is generally known as energy harvesting: harvesting minute vibrations (energy) from the surrounding environment and converting the minute vibrations into electric power. However, the direction of the external vibration is non-uniform and it is difficult to employ the external vibration for instruments in fields requiring precision such as optical products like the projection optical instrument 20.

The projection optical instrument 20 in the second modification requires strictness regarding the direction of the projection light L22, and thus implementation of the projection optical instrument 20 with an ordinary type of mechanism employed for the energy harvesting has been difficult. The strictness regarding the direction of the projection light L22 is, for example, a condition that the incident light L21 has to be incident on a surface region in the projection optical member 220 on which the direction of the incident light L21 is the same when the position is the same, and so on. In other words, the strictness regarding the direction of the projection light L22 is, for example, a condition that the incident light L21 has to be incident on the surface region of the projection optical member 220 in the same direction when the incident light L21 is incident on the same position, and so on.

This is because it is difficult in terms of design to precisely maintain the position and attitude of the projection optical member 220 as in the projection optical instrument 20 in the second modification by use of structure for the energy harvesting capable of withstanding energy wear such as frictional wear.

Therefore, the second modification employs structure for oscillating the projection optical member 220 relative to the light source unit 210 while maintaining the distance between the light source unit 210 and the light incidence surface of the projection optical member 220 to be a constant distance. Thus, according to the second modification, wobbling of the optical axis of the projection light L22 is hardly influenced by the oscillation of the projection optical member 220. Namely, the inclination of the optical axis of the projection light L22 with respect to the Z-axis direction is hardly influenced by the oscillation of the projection optical member 220.

Moreover, the projection optical instrument 20 according to the second modification has the following social significance and advantages:

The semiconductor light source units including semiconductor light sources are small-sized compared to light source units including incandescent lamps or the like (thermal light source units), and thus the semiconductor light source units are suitable for downsizing or multifunctionalization of optical instruments. Meanwhile, the importance of thermal design of optical instruments is increasing with the prevalence of the light source units employing semiconductor devices as light emission sources (semiconductor light source units).

For example, since the semiconductor light source unit is small-sized, light with high energy density concentrates at an optical member (e.g., lens, fluorescent body or the like) of the light source unit. Then, a partial temperature rise in the optical member of the light source unit causes change in the optical characteristics of the optical member of the light source unit. Therefore, configurations in which the light source unit is provided with a heat radiation structure to cool the light source unit have been commonly employed. Alternatively, configurations in which the light source unit is provided with a heat radiation fan to cool the light source unit have been commonly employed.

Mounting a cooling device on the projection optical instrument 20 is undesirable from the viewpoint of occupied volume, weight or power consumption, but is a necessary measure in terms of stabilizing the illuminating performance. Accordingly, the projection optical instrument 20 is equipped with the function of inhibiting the temperature rise of the light source unit optical member 212; however, downsizing of the configuration, lowering of energy, simplification of the mounting, or the like is required.

The projection optical instrument 20 in the second modification employs a member including a light emission member (e.g., fluorescent body) as the projection optical member 220. Thus, by adding structure for oscillating the hold member 150 holding the projection optical member 220, performance degradation of the light emission member (e.g., fluorescent body) as the projection optical member 220 caused by heat is inhibited and the performance of the projection light L22 is stabilized.

Further, in the second modification, the degree of freedom is high in regard to the arrangement and structure of the vibration application unit 270. Furthermore, in a case where the external vibration is used, no special vibration generating device is necessary, and thus it is also possible to improve an already-existing conventional projection optical instrument into structure employing the second modification.

(4) Third Modification

(4-1) Configuration

Figure 7:
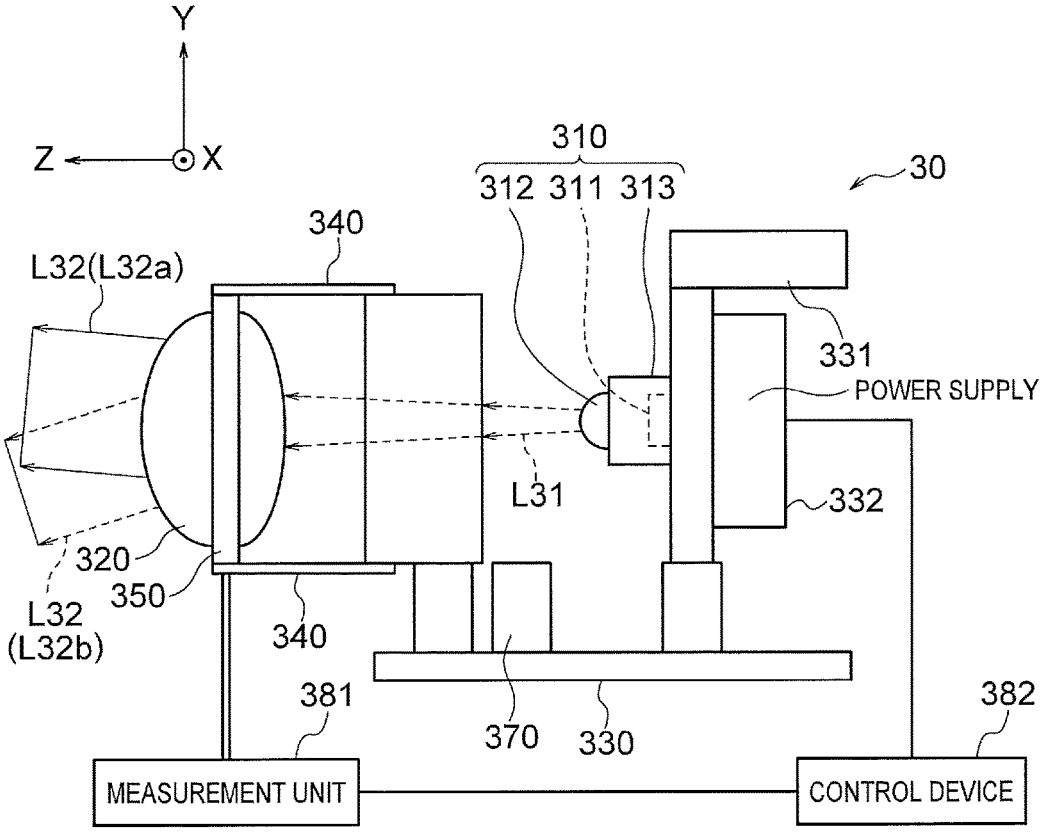
FIG. 7 is a side view schematically showing the configuration of a projection optical instrument according to a third modification of the present invention.

FIG. 7 is a side view schematically showing the configuration of a projection optical instrument 30 according to a third modification of the present invention.

The projection optical instrument 30 is, for example, a headlight device that can be mounted on a vehicle such as an automobile or a motorcycle. Alternatively, the projection optical instrument 30 is, for example, a headlight device that can be mounted on a movable object such as a train, a marine vessel or an airplane. The projection optical instrument 30 has a function of changing the direction of projection light L32 without using a driving component.

A headlight device for a vehicle is a projection optical instrument that emits intense light towards a distant region, and the shape of the projection light is strictly stipulated by laws and regulations. For example, a headlight device for passing by each other (or a low beam) for an automobile projects a light distribution with a cut line formed in the horizontal direction so as not to dazzle a driver of a leading vehicle traveling in front of the own vehicle or a driver of an oncoming vehicle traveling in an opposite lane (or an oncoming lane). For example, a headlight device for traveling (or a high beam) for an automobile projects a light distribution that illuminates a distant region as far ahead as 100 m or farther.

The "light distribution" means luminosity distribution of the light source (projection optical instrument 30) with respect to space. In other words, the "light distribution" means spatial distribution of the light emitted from the light source (projection optical instrument 30). A "light distribution pattern" means the shape of a light flux and light intensity distribution resulting from the direction of the light emitted from the light source (projection optical instrument 30). Therefore, moving the illumination direction of the light in the left-and-right direction or in the up-and-down direction is included in a change in the "light distribution pattern". The shape of a light distribution stipulated by a law, regulation or the like is also referred to as a light distribution pattern, for example. Further, "lighting distribution" means distribution of intensity of light with respect to the direction of the light emitted from the light source (projection optical instrument 30).

In regard to the light distribution of the headlight device during the traveling of the vehicle, it is permitted to switch the light distribution pattern within the range satisfying the laws and regulations. For example, when the front end of the vehicle is tilted downward, the driver's field of vision can be maintained well by adjusting the optical axis of the projection light L32 upward.

The projection optical instrument 30 according to the third modification maintains the driver's field of vision well and enables safe driving, by changing particularly the direction of the projection light L32 in the light distribution pattern of the vehicle headlight device.

Further, the projection optical instrument 30 according to the third modification is applicable to a headlight device including a plurality of light modules. The headlight device of the multiple light type forms one light distribution pattern by superimposing light distributions of the plurality of light modules (projection optical instruments 30) on each other. In this case, the projection optical instrument 30 is capable of changing the shape of the light distribution pattern with respect to the headlight device.

As shown in FIG. 7, the projection optical instrument 30 according to the third modification includes a light source unit 310 as a light distribution light source unit that forms the light distribution pattern, a projection optical member (projection lens) 320 as an optical member that projects the light distribution pattern forward, and bend parts 340, as principal components. The projection optical instrument 30 can include a vibration application unit 370 that drives the projection optical member 320. Further, the projection optical instrument 30 can include a hold member 350 holding the projection optical member 320, a housing 330, a power supply (e.g., supply voltage regulation circuit) 332 that controls the output of the light source unit 310 in conjunction with the vibration application unit 370, and a heat radiation plate 331 that cools the light source unit 310 or the power supply 332. Incidentally, the power supply 332 may be provided at a position separate from the light source unit 310. The power supply 332 may also be a circuit provided as a part of the light source unit 310.

The light source unit 310 includes a light emission source 311. The light source unit 310 can include a light source unit optical member 312 as a light distribution optical system and a light source unit housing 313 that houses these components. The light source unit 310 forms the light distribution pattern by using light emitted from the light emission source 311, through the light source unit optical member 312, as incident light L31 for the projection optical member 320.

The light emission source 311 is an LED, for example. Alternatively, the light emission source 311 is an electroluminescence device, a semiconductor laser, or a light emission source that irradiates fluorescent material applied on a plane surface with excitation light and thereby causes the fluorescent material to emit light. Since the light emission source 311 generates heat, the light emission source 311 is desired to be fixed to a radiator (e.g., heat radiation plate 331) for releasing the heat to the outside.

The light source unit optical member 312 transforms the light emitted from the light emission source 311 into the incident light L31 in which the light distribution pattern has been famed. The light source unit optical member 312 is an optical system formed of one or more optical elements. The light source unit optical member 312 may include a lens or a light guide member as the optical element, for example. The light source unit optical member 312 may include a shade or a reflector as the optical element, for example.

The light source unit housing 313 holds the light emission source 311 and the light source unit optical member 312, for example. The light source unit housing 313 is attached to the heat radiation plate 331, for example.

The power supply 332 has a function of supplying the light emission source 311 with supply power. The power supply 332 also has a function of controlling the supply power at a cycle at least shorter than that of the vibration generated by the vibration application unit 370.

Specifically, the power supply 332 is capable of increasing and decreasing the supply power at a frequency corresponding to the vibration frequency of the vibration applied by the vibration application unit 370 on the basis of a control signal from a control device 382. The power supply 332 is capable of increasing and decreasing the supply power at a cycle synchronized with the change in the vibration applied by the vibration application unit 370, for example. The supply power increases and decreases periodically, for example.

The power supply 332 has the function of periodically changing the magnitude of the supply power and may have a function of changing the cycle of the change. The power supply 332 may carry out the control of the supply power on the basis of current value control or voltage value control according to the control signal from the control device 382.

The hold member 350, the bend parts 340 and the housing 330 shown in FIG. 7 are members having functions similar to those of the hold member 150, the bend parts 140 and the housing 130 in the embodiment (FIG. 1). Incidentally, the bend part 340 may include a member corresponding to the resonance point adjustment member 144 shown in FIG. 1. The projection optical instrument 30 may include a measurement unit 381 as a means for measuring the position of the hold member 350. The measurement unit 381 is capable of measuring the displacement or the displacement amount of the hold member 350.

The measurement unit 381 may have the following configuration, for example:

For example, the hold member 350 has a slit (or a through hole). The measurement unit 381 may include a photodetector that detects the projection light L32 passing through the slit of the hold member 350. Moreover, the measurement unit 381 may include a photodetector that detects light from another light source (not shown in the drawings) passing through the slit of the hold member 350.

In this case, the displacement of the hold member 350 can be measured or estimated on the basis of variation in an optical signal detected by the photodetector. An example of the variation in the optical signal detected by the photodetector is, for example, the optical signal reaching a high level when the light is passing through the slit and reaching a low level when the light is screened by the hold member 350. The displacement of the hold member 350 may also be, for example, the displacement amount or the cycle of the displacement.

As such a configuration, the light source unit housing 313 has a slit (or a through hole). The measurement unit 381 may include a photodetector that detects light passing through the slit of the light source unit housing 313. The measurement unit 381 may include a photodetector that detects light from another light source (not shown in the drawings) passing through the slit of the light source unit housing 313.

In this case, the displacement of the hold member 350 can be measured or estimated on the basis of variation in an optical signal detected by the photodetector. An example of the variation in the optical signal detected by the photodetector is, for example, the optical signal reaching a high level when the light is passing through the slit and the optical signal reaching a low level when the light is screened by the hold member 350. The displacement of the hold member 350 may also be, for example, the displacement amount or the cycle of the displacement.

The bend parts 340 may be provided with a measurement unit 381 as a measurement device that measures deformation or vibration. The control device 382 may perform control so as to stop the displacement (or oscillation or vibration) of the hold member 350 and the bend parts 340 when the displacement of the hold member 350 or the bend parts 340 exceeds a preset threshold level.

The vibration application unit 370 has a configuration similar to that of the vibration application unit 170 in the embodiment. The vibration application unit 370 may be, for example, a vibration transmission member that transmits vibration of an automobile engine to the projection optical instrument 30. The vibration application unit 370 may also be, for example, a piezoelectric element that applies vibration to the vicinity of a connection part between the housing 330 and the bend parts 340. The vibrational characteristics of the bend parts 340 are desired to be designed to coincide with a typical vibration frequency of the vibration application unit 370.

As above, the control device 382 increases and decreases the intensity of the projection light L32 by controlling the power supply 332 in parallel with the oscillation of the projection light L32 caused by the vibration of the projection optical member 320. Hereby, the control device 382 is capable of controlling the direction of the projection light L32. The vibration of the projection optical member 320 is applied by the vibration application unit 370.

For example, the control device 382 increases and decreases the light amount so as to increase the light amount when the direction of the projection light L32 exiting from the projection optical member 320 is L32*a* and to decrease the light amount (or set the light amount at zero) when the direction of the projection light L32 is L32*b*. Hereby, the control device 382 is capable of setting the direction of the projection light L32 at the direction of the projection light L32*a* inclined in the +Y-axis direction.

(4-2) Operation

The projection optical member 320 receives the incident light L31 emitted from the light source unit 310 and emits the projection light L32 forward. The light incidence surface and the light exit surface of the projection optical member 320 are, for example, free-form surfaces projecting the light distribution pattern forward without spreading the light distribution pattern.

In the projection optical instrument 30 according to the third modification, the center of the light incidence surface and the center of the light exit surface of the projection optical member 320 can be placed at positions corresponding to the optical axis of the incident light L31 and the optical axis of the projection light L32 (reference positions), for example. Further, by the oscillation (vibration) of the projection optical member 320, the optical axis of the incident light L31 can be made to correspond to a position deviating from the center of the light incidence surface of the projection optical member 320. Furthermore, the optical axis of the projection light L32 can be made to correspond to a position deviating from the center of the light exit surface of the projection optical member 320.

In a case where the projection optical instrument 30 according to the third modification is applied to the headlight device, the projection optical instrument 30 projects light having a light distribution pattern satisfying the law or regulation of the low beam or the high beam forward as the projection light L32 when the incident light L31 is at the reference position.

In a case where the projection optical instrument 30 according to the third modification is applied to the headlight device of the multiple light type, each of the projection optical instruments 30 projects part of light having a light distribution pattern satisfying the law or regulation of the low beam or the high beam forward as the projection light L32 when the incident light L31 is at the reference position.

In a case where the projection optical instrument 30 according to the third modification has a function of projecting a light distribution pattern in an arbitrary shape within the range satisfying the law or regulation of the low beam or the high beam, the projection optical instrument 30 projects light having a light distribution pattern serving as a reference as the projection light L32 when the incident light L31 is at the reference position.

A case where the projection optical member 320 is a lens that forms the image of the light distribution pattern of the incident light L31 at a position 25 m ahead at a magnification of 1000 times will be explained below. In this case, if the light incidence surface of the projection optical member 320 is translated leftward (in the +X-axis direction) from the optical axis of the incident light L31 by a distance of 2.0 mm, the moving distance d of the optical axis of the projection light L32 at a distance of D=25 m ahead is 1000 mm in the +X-axis direction. In this case, an inclination θ of the projection light L32 around a rotation axis extending in the up-and-down direction (Y-axis direction) is represented by the following expression (2):

$$\theta=\tan^{-1}(d/D)$$

$$=\tan^{-1}(1000\ (\text{mm})/25000\ (\text{nm}))$$

$$=2.29\ (\text{degrees}) \qquad (2)$$

As above, the light distribution pattern of the projection light L32 can be rotated counterclockwise with respect to the +Y-axis by minutely translating the projection optical member 320 in the +X-axis direction. Similarly, the light distribution pattern of the projection light L32 can be rotated clockwise with respect to the +Y-axis by minutely translating the projection optical member 320 in the −X axis direction. Incidentally, the translating is the same as the translational motion.

Similarly, the light distribution pattern of the projection light L32 can be rotated clockwise with respect to the +X-axis by minutely translating the projection optical member 320 in the +Y-axis direction. Similarly, the light distribution pattern of the projection light L32 can be rotated counterclockwise with respect to the +X-axis by minutely translating the projection optical member 320 in the −Y axis direction.

As explained above, by slightly translating the projection optical member 320, the optical axis of the projection light L32 can be moved in the direction of the translation of the projection optical member 320.

The projection optical member 320 and the hold member 350 repeat constant oscillation by the bend parts 340 and the vibration application unit 370. In regard to the hold member 350, the magnitude of the amplitude of the vibration of the bend parts 340 is previously measured according to the output of the vibration application unit 370 (e.g., intensity and frequency of the vibration and so on), for example. If such data are previously acquired, the displacement of the projection optical member 320 is estimated from the output of the vibration application unit 370 (e.g., intensity and frequency of the vibration and so on).

The displacement of the hold member 350 may also be directly measured by a measurement device that measures vibration (or displacement), for example. The vibration (or displacement) of the hold member 350 may be indirectly estimated (or measured) from the magnitude of the deformation of the bend parts 340, for example.

The power supply 332 periodically controls the supply power corresponding to the vibration frequency of the vibration application unit 370 or the displacement amount of the hold member 350. The power supply 332 regulates the light amount of the light emission source 311 and thereby increases and decreases the luminosity of the incident light L31 and the projection light L32 for the projection optical member 320.

The projection optical member 320 is oscillating at a constant cycle. Therefore, the increase and decrease of the luminosity of the incident light L31 are made to coincide with (i.e., synchronized with) the cycle of the oscillation of the hold member 350. Hereby, the projection optical instrument 30 is capable of forming a constant light distribution pattern by regulating the amount of light projected as the projection light L32 per unit time.

In a case where the cycle of the vibration of the projection optical member 320 is sufficiently shorter than the range recognizable to human eyes, the light distribution of the light projected by the projection optical instrument 30 can be approximated by the mean values of the light distribution of the projection light L32 increased and decreased periodically.

Let us assume here, for example, that the bend parts 340 make the hold member 350 repeat minute oscillation in the +X-axis direction and the X axis direction. The control device 382 controls the power supply 332 so that the light amount of the light emission source 311 becomes the maximum when the hold member 350 is situated at the end in the +X-axis direction. Further, the control device 382 controls the power supply 332 so that the light amount of the light emission source 311 becomes the minimum when the hold member 350 is situated at the end in the −X axis direction. With this control, the light distribution pattern of the projection light L32 is recognized to have rotated counterclockwise with respect to the +Y-axis as a whole.

Let us assume here, for example, that the bend parts 340 make the hold member 350 repeat minute oscillation in the +X-axis direction and the −X axis direction. The control device 382 controls the power supply 332 so that the light amount of the light emission source 311 becomes the minimum when the hold member 350 is situated at the end in the +X-axis direction. Further, the control device 382 controls the power supply 332 so that the light amount of the light emission source 311 becomes the maximum when the hold member 350 is situated at the end in the −X axis direction. With this control, the light distribution pattern of the projection light L32 is recognized to have rotated clockwise with respect to the +Y-axis as a whole.

Let us assume here, for example, that the bend parts 340 make the hold member 350 repeat minute oscillation in the +Y-axis direction and the −Y axis direction. The control device 382 controls the power supply 332 so that the light amount of the light emission source 311 becomes the minimum when the hold member 350 is situated at the end in the +Y-axis direction. The control device 382 controls the power supply 332 so that the light amount of the light emission source 311 becomes the maximum when the hold member 350 is situated at the end in the −Y axis direction. With this control, the light distribution pattern of the projection light L32 is recognized to have rotated counterclockwise with respect to the +X-axis as a whole.

Let us assume here, for example, that the bend parts 340 make the hold member 350 repeat minute oscillation in the +Y-axis direction and the −Y axis direction. The control device 382 controls the power supply 332 so that the light amount of the light emission source 311 becomes the maximum when the hold member 350 is situated at the end in the +Y-axis direction. The control device 382 controls the power supply 332 so that the light amount of the light emission source 311 becomes the minimum when the hold member 350 is situated at the end in the −Y axis direction. With this control, the light distribution pattern of the projection light L32 is recognized to have rotated clockwise with respect to the +X-axis as a whole.

The oscillation of the hold member 350 supported by the bend parts 340 is not limited to the +X-axis direction and the −X axis direction or the +Y-axis direction and the −Y axis direction. Any direction in a plane orthogonal to the optical axis can be specified as the direction of the oscillation of the hold member 350.

The increase and decrease in the light amount of the light emission source 311 can be represented by a rectangular wave, for example. The displacement amount of the hold member 350 and the direction of the optical axis of the projection light L32 are determined in a one-to-one correspondence. Based on this fact, the light emission source 311 is lit up in periods in which the hold member 350 is situated at a position at which the optical axis of the projection light L32 is pointed in an intended direction (lighting periods) and the light emission source 311 is extinguished in the other periods.

In this case, since the lighting time per cycle of the rectangular wave is short, the power supply 332 is capable of temporarily supplying the light emission source 311 with supply power higher than the supply power supplied in a case of continuously supplying the electric power. It is desirable to adjust the magnitude of the supply power so that the integral value of the light amount irradiated per cycle can be accommodated in the lighting period.

The increase and decrease in the light amount of the light emission source 311 can also be represented by a sinusoidal wave, for example. The light emission source 311 is lit up by setting the supply power at a value corresponding to the peak of the semisinusoidal wave in periods in which the hold member 350 is situated at a position at which the optical axis of the projection light L32 is pointed in an intended direction (lighting periods) and the light emission source 311 is extinguished by setting the supply power at a value corresponding to the bottom of the sinusoidal wave when the optical axis is in a direction other than the intended direction.

As above, in a case where the light amount of the light emission source 311 is controlled by the power supply 332, the light amount irradiated per cycle can be increased compared to the control by using a rectangular wave.

In a headlight device of the multiple light type employing a plurality of projection optical instruments 30, it is necessary to integrate the light amount in regard to a plurality of light distribution patterns corresponding to a plurality of optical axes. Thus, the multiple light type headlight device is designed by taking the summation of the light distribution patterns of the projection light L32 into consideration.

(4-3) Effect

As described above, with the projection optical instrument 30 according to the third modification, the shape, the intensity and the optical characteristics of the projection light L32 can be changed by the oscillation (vibration) of the projection optical member 320 relative to the light source unit 310. The projection optical instrument 30 is capable of controlling the shape, the intensity and the optical characteristics of the projection light L32. As a result, the projection optical instrument 30 is capable of stabilizing the characteristics of the projection light L32.

Further, the projection optical instrument 30 according to the third modification employs the bend parts 340 oscillating the projection optical member 320 in at least one direction orthogonal to the optical axis (Z-axis), the vibration application unit 370, and a small-sized support part. Accordingly, downsizing and simplification of the projection optical instrument 30 are possible.

Furthermore, the projection optical instrument 30 according to the third modification is capable of controlling the shape, the intensity or the optical characteristics of the projection light L32 of the projection optical instrument 30 by periodically controlling the output intensity of the light source unit 310. In addition, the projection optical instrument 30 is capable of controlling the light distribution of the projection light L32.

The technology of controlling the light distribution by translating the projection lens is a publicly known technology as described in the Patent References 2 and 3. However, as described in the Patent References 2 and 3, in order to translate the projection optical member, a drive source and a transmission mechanism unit for transmitting force from the drive source are required, in addition to the mechanism for holding the projection optical member. Accordingly, the instrument increases in size and also in the number of components. The increase in the number of components leads to looseness or rattling due to tolerances of the components, and to the wobbling of the optical axis due to vibration of the vehicle. Equipping a mechanism for translating the projection lens involves technical difficulty in design in terms of enlargement of the instrument and the wobbling of the optical axis.

The projection optical instrument 30 according to the third modification is capable of displacing the optical axis of the projection light L32 in a specific plane containing the optical axis with the simple configuration in which the projection optical member 320 and the hold member 350 are connected to the housing 330 via the bend parts 340.

The number of components of the projection optical instrument 30 according to the third modification is significantly small in comparison with conventional mechanism components. The vibration application unit 370 employs vibration of an automobile, for example. Alternatively, the vibration application unit 370 employs a piezoelectric element, for example. Thus, the vibration application unit 370 is sufficiently small compared to conventional drive sources. The vibration application unit 370 does not need to be directly connected to the hold member 350; the vibration application unit 370 may be indirectly connected to the hold member 350 via the bend parts 340. In this case, the structure of the mechanism for transmitting vibration can be simplified.

In the projection optical instrument 30 according to the third modification, the projection optical member 320 is movable in a direction parallel to a plane orthogonal to the optical axis by the hold member 350 and the bend parts 340, and the projection optical member 320 is firmly fixed in regard to other directions. Namely, the projection optical instrument 30 does not move the projection optical member 320 in the other directions.

Further, the projection optical instrument 30 oscillates (vibrates) the projection optical member 320 relative to the light source unit 310 at a constant cycle by use of the bend parts 340 and the vibration application unit 370. Therefore, the projection optical instrument 30 according to the third modification can have a solid configuration in which the wobbling of the optical axis with respect to the intended optical axis direction hardly occurs.

The projection optical instrument 30 according to the third modification is capable of providing an unprecedentedly small-sized and stable light distribution pattern by using the oscillation of the projection lens serving as the projection optical member 320 and the periodical control of the supply power of the power supply 332 supplying electric power to the light emission source 311 as means for changing the direction of the optical axis. Thus, with the projection optical instrument 30 according to the third modification, it is possible to form a vehicle headlight device equipped with the translating mechanism for the projection lens as the projection optical member 320 so that its size is equivalent to the size of a vehicle headlight device without the translating mechanism for the projection lens.

Moreover, the projection optical instrument 30 according to the third modification has the following social significance and advantages:

The semiconductor light source unit has recently been approved as the light source unit of a vehicle headlight device by laws and regulations in Europe. Thanks to the realization of downsizing of the light modules by installing the semiconductor light source unit (e.g., LED light source unit) in a vehicle headlight device, a headlight device of the multiple light type, that includes modularized multiple light modules arranged therein and achieves a light distribution pattern by superimposition of light distributions, has been developed and is becoming more and more prevalent. With respect to the vehicle headlight device of the multiple light type, downsizing of the forward projection area and thinning are especially expected.

Since AFS (Adaptive Front lighting System), changing the headlight device's irradiation pattern in the middle of traveling in response to the motion of the vehicle or variations in the external environment, has been stipulated by laws and regulations in Europe, a system of a headlight device capable of changing the light distribution pattern in the left-and-right direction or the up-and-down direction is also being requested. Appropriately controlling the light distribution pattern for traveling and the light distribution pattern for passing by each other to suit the environmental conditions by moving the light distribution pattern in the left-and-right direction or the up-and-down direction is expected as a technology preventing the dazzling of leading/oncoming vehicle drivers or pedestrians and contributing to social traffic safety.

In the third modification, in regard to the projection optical instrument 30 that projects forward the light for forming a light distribution pattern, a small-sized device capable of changing the direction of the light distribution pattern can be realized by performing oscillation of the hold member 350 holding the projection optical member 320 and increasing and decreasing of the supply power supplied to the light emission source 311 of the light source unit 310 at the same cycle. For example, the vehicle headlight device of the multiple light type includes an instrument (control device) for controlling the directions of a plurality of light distribution patterns. This control device can be the control device 382 of one of the plurality of projection optical instruments 30. As above, the projection optical instrument 30 according to the third modification enables improvement of safety and improvement of design when it is applied to a headlight device.

(5) Fourth Modification

(5-1) Configuration

Figure 8:
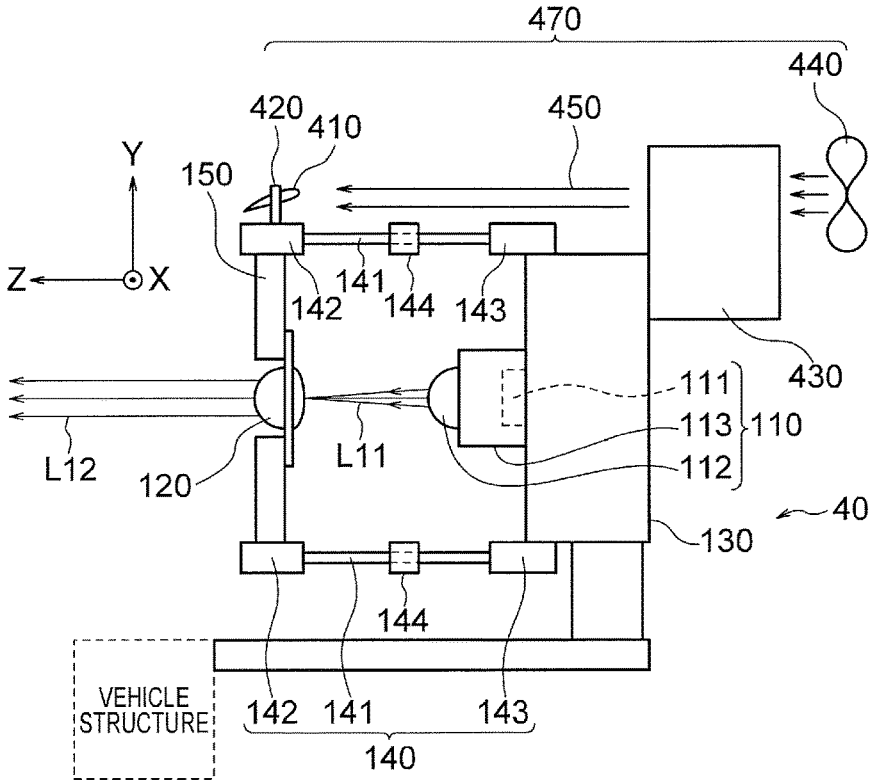
FIG. 8 is a side view schematically showing the configuration of a projection optical instrument according to a fourth modification of the present invention.

FIG. 8 is a side view schematically showing the configuration of a projection optical instrument 40 according to a fourth modification of the present invention. In FIG. 8, components identical or corresponding to those shown in FIG. 1 are assigned the same reference characters as in FIG. 1.

The projection optical instrument 40 is, for example, a headlight device that can be mounted on a vehicle such as an automobile or a motorcycle. The projection optical instrument 40 is, for example, a headlight device that can be mounted on a movable object such as a train, a marine vessel or an airplane. The projection optical instrument 40 according to the fourth modification differs from the projection optical instrument 10 according to the embodiment in including a vibration application unit 470 employing a flow of fluid (e.g., gas or liquid) instead of the vibration application unit 170 in the projection optical instrument 10 according to the embodiment. Further, the projection optical instrument 40 according to the fourth modification includes a heat radiation plate 430.

Except these features, the projection optical instrument 40 according to the fourth modification is equivalent to the projection optical instrument 10 according to the embodiment. The projection optical instrument 40 according to the fourth modification may include the measurement unit 181 or the photodetector 183 and the control device 182 for controlling the amount of light emission of the light emission source similarly to the projection optical instrument 10 shown in FIG. 4 and FIG. 5. The control device 182 in the fourth modification controls a flow source 440 as well.

As shown in FIG. 8, the projection optical instrument 40 includes a stator vane 410 as a vane-shaped member for generating pressure gradient when placed in a flow of fluid 450. Further, the projection optical instrument 40 can include a stator vane support part 420 as a structure for supporting the stator vane 410 on the fixation member 142.

The "stator vane" generally means a vane used for rectifying fluid in a turbine. In this example, the "stator vane" is employed as a vane-shaped member for transmitting vibration to the projection optical member 120.

Furthermore, the projection optical instrument 40 can include the heat radiation plate 430 as a heat radiator fixed to the main body structure (e.g., housing 130) of the projection optical instrument 40 and the flow source (e.g., blower fan) 440 that causes a flow of fluid heading towards the heat radiation plate 430 and the stator vane 410. However, it is unnecessary to provide the heat radiation plate 430 in a case where the light source unit 110 does not need heat radiation.

The stator vane 410, the stator vane support part 420 and the flow source 440 constitute the vibration application unit 470 having the same function as the vibration application unit 170 in the embodiment. The pressure gradient generated by the vibration application unit 470 means a change or the amount of change in force pointing towards the upper surface or the lower surface of the stator vane 410 caused by pressure difference between the upper surface and the lower surface of the stator vane 410 according to fluid mechanics, for example. Incidentally, it is also possible to provide two or more stator vanes 410 and/or two or more stator vane support parts 420.

The stator vane 410 is a structural member in a thin plate shape or a vane shape that generates the pressure gradient mainly with respect to the oscillation direction of the hold member 150 (Y-axis direction in FIG. 8) by using the flow of the fluid 450. The stator vane support part 420 is a structural member that connects the stator vane 410 and the hold member 150. The stator vane 410 and the hold member 150 are firmly connected, for example.

The stator vane support part 420 may have a mechanism for adjusting the direction of the stator vane 410 with respect to the fluid 450, that is, the angle of attack. The flow of the fluid 450 and the shape of the stator vane 410 are not particularly limited as long as their combination causes vibration in the Y-axis direction to the hold member 150.

The fluid 450 is gas inside the projection optical instrument 40, for example. Alternatively, the fluid 450 can be liquid inside the projection optical instrument 40. The flow of the fluid 450 is a flow of gas or liquid. The flow of the fluid 450 can also include convection caused by the light source unit 110, the heat radiation plate 430 or another heat source in the projection optical instrument 40.

The flow source 440 is, for example, a flow generating device having the function of generating the flow of the fluid 450 heading towards the stator vane 410. The flow source 440 is desired to be a device capable of controlling the amount, speed, density or the like of the fluid 450 heading towards the stator vane 410. The flow source 440 can be formed of a rotor vane and a rotation generating device, such as a motor, for rotating the rotor vane, for example. Alternatively, the flow source 440 can be a window device periodically opening and closing a duct that takes in an external air flow, for example. In the fourth modification, an air-cooling fan that cools the heat radiation plate 430 with air is particularly employed as the flow source 440. However, the flow source 440 is not limited to the configuration shown in FIG. 8. The air-cooling fan is an example of a blower device.

Figure 9:
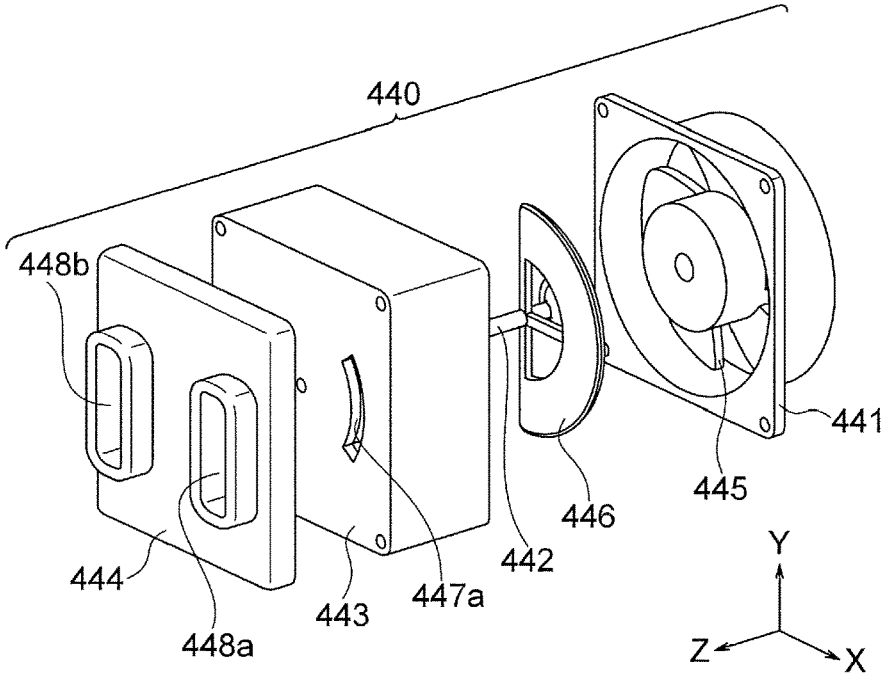
FIG. 9 is a perspective view schematically showing the structure of a flow source of a vibration application unit of the projection optical instrument according to the fourth modification of the present invention.
Figure 10:
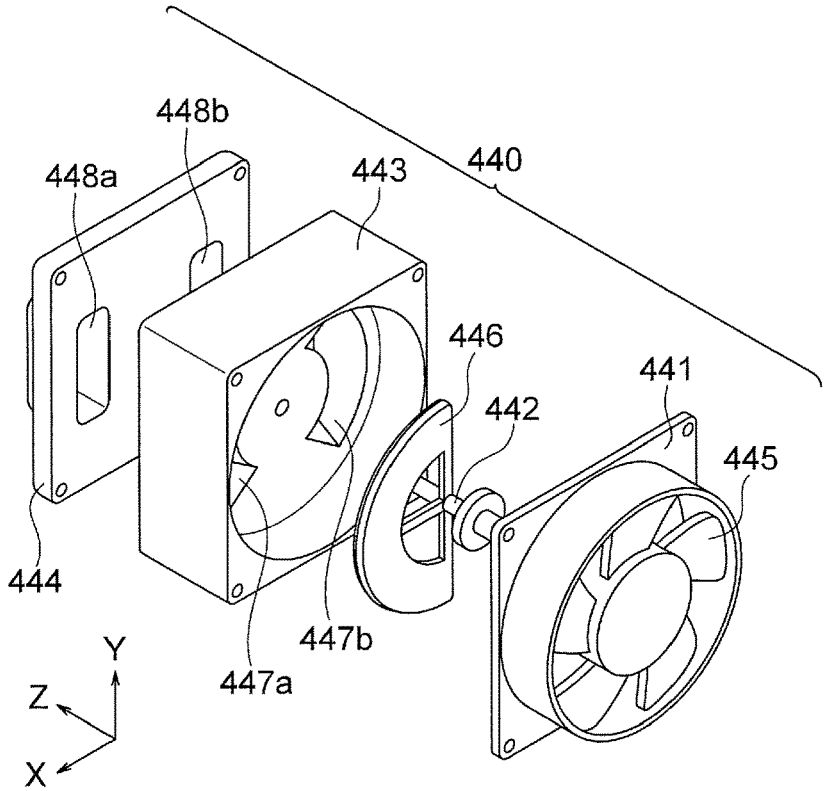
FIG. 10 is a perspective view schematically showing the structure of the flow source of the vibration application unit of the projection optical instrument according to the fourth modification of the present invention.

FIG. 9 is a perspective view schematically showing the structure of the flow source 440 of the vibration application unit 470 of the projection optical instrument 40 according to the fourth modification. FIG. 10 is also a perspective view schematically showing the structure of the flow source 440 of the vibration application unit 470 of the projection optical instrument 40 according to the fourth modification.

As shown in FIG. 9 and FIG. 10, the flow source 440 can include an air-cooling fan 441 that generates a flow of air as the fluid and a rectification screen shaft 442 that rectifies the flow of air generated by the air-cooling fan 441. "Rectification" means to make gas or liquid flow in one direction, or to smooth the turbulence of a flow of gas or liquid. The flow source 440 can include a rectification housing 443 having a plurality of outlets for distributing the flow of air generated by the air-cooling fan 441 and a flow guide housing 444 that guides the gas flowing out from the rectification housing 443 towards a target direction.

The air-cooling fan 441 includes a rotor vane 445 that generates a flow of gas in its axial direction by means of rotation and a rotary power source (not shown in the drawings), such as a motor, that generates drive force for rotating the rotor vane 445. The air-cooling fan 441 can include a drive force transmission mechanism, such as gears (gear wheels), that transmits the drive force generated by the rotary power source to a rotary shaft (not shown in the drawings) supporting the rotor vane 445.

The rectification screen shaft 442 has a screen plate 446 that screens part of the flow of gas in the Z-axis direction. The rectification screen shaft 442 can have a shaft bearing part (not shown in the drawings) connected to the rotary shaft (not shown in the drawings) supporting the rotor vane 445 and a shaft bearing part (not shown in the drawings) connecting the rectification housing 443 and the rotary shaft (not shown in the drawings).

The rectification housing 443 can have two or more rectification holes 447*a*, 447*b* and a shaft bearing part (not shown in the drawings) supporting the rectification screen shaft 442. The rectification housing 443 can have a ball bearing or a solid lubrication part in order to reduce friction of a slide part with the rectification screen shaft 442.

In the fourth modification, two rectification holes are formed and are respectively referred to as a rectification hole 447*a* and a rectification hole 447*b*. The number of the rectification holes of the rectification housing 443 is not limited to two. The rectification holes 447*a*, 447*b* are arranged parallel to the screen plate 446, and one of the rectification holes 447*a*, 447*b* is closed by the rotary motion of the screen plate 446. The air-cooling fan 441 is fixed to the rectification housing 443.

The flow guide housing 444 has as many flow guide holes 448*a*, 448*b* as the rectification holes 447*a*, 447*b*. The flow guide housing 444 is fixed to the rectification housing 443. The gas flowing out from the rectification holes 447*a*, 447*b* is distributed to intended positions via the flow guide holes 448*a*, 448*b*. The rectification hole 447*a* discharges the fluid 450 towards the stator vane 410 via the flow guide hole 448*a*, for example. The number of rectification holes 447*a*, 447*b* and the number of flow guide holes 448*a*, 448*b* are equal to or greater than the number of stator vanes 410. The flow guide holes 448*a*, 448*b* do not necessarily have to send the gas to the stator vane 410.

(5-2) Operation

The control device 182 varies the flow rate, speed, density or another physical quantity of the fluid 450 by controlling the flow source 440 of the vibration application unit 470, thereby causes temporal variation in the pressure gradient occurring on the stator vane 410, and thereby makes the hold member 150 oscillate.

The air-cooling fan 441 of the flow source 440 generates a stable flow of gas, the rectification screen shaft 442 and the rectification housing 443 divide the flow of gas so that the gas is alternately discharged from the rectification holes 447*a* and 447*b*, and thus a flow of gas, i.e., the fluid 450, having periodicity is generated from the rectification hole 447*a*.

The flow rate of the fluid 450 increases and decreases periodically in proportion to the open area of the rectification hole 447*a* with respect to the screen plate 446. In a case where the air-cooling fan 441 rotates at a constant angular speed, for example, variation per unit time is constant in the change in the flow rate of the fluid 450.

The screen plate 446 is in an asymmetric shape like a semiarc, for example. The rectification hole 447*a* is an arc-shaped through hole that is open in a range corresponding to 1/4 in the circumferential direction.

The flow rate of the fluid 450 changes to four types in four regions in the circumferential direction of the screen plate 446. The four regions will be referred to as a region A, a region B, a region C and a region D, for example. The four regions are obtained by dividing the screen plate 446 into four in the circumferential direction, for example.

The flow rate of the fluid 450 is 0 (zero) in a range corresponding to the first 1/4 in the circumferential direction (region A). The flow rate of the fluid 450 monotonically increases in a range corresponding to the next 1/4 (region B). The flow rate of the fluid 450 is constant in a range corresponding to the next 1/4 (region C). The flow rate of the fluid 450 monotonically decreases in a range corresponding to the last 1/4 (region D). These make the flow of the fluid 450 a periodical flow.

Specifically, the flow source 440 generates a flow whose flow rate increases and decreases at the same cycle as the rotation cycle of the air-cooling fan 441. By making the rotation cycle of the air-cooling fan 441 coincide with the resonance frequency (or resonance vibration frequency) of the bend parts 140, the hold member 150 is enabled to achieve stable oscillation even with a slight air flow.

The fluid discharged from the flow guide holes 448*a*, 448*b* may reach the stator vane 410 after making contact with a part of the heat radiation plate 430 or passing through the vicinity of the heat radiation plate 430. The heat radiation plate 430 is capable of transmitting part of the heat to the fluid via the flow guide holes 448*a*, 448*b*. In other words, the flow source 440 can have the function of cooling down the light source unit 110 via the heat radiation plate 430.

In recent years, the thermal design of projection optical instruments is shifting from natural cooling to forced cooling due to the increase in the output of semiconductor light source units, and accordingly, the structure is becoming more complicated. The projection optical instrument 40 can be formed by adding some simple components to the heat radiation plate 430 and the air-cooling fan used for the forced cooling.

In general, the means employing wind used for the forced cooling as drive force is publicly known as a common means in the energy harvesting. However, employing the pressure gradient formed by a stator vane as a means for applying drive force to a component requiring strict accuracy in its movable direction such as the projection optical member is not common. This is because it is technically difficult to achieve strong drive force overcoming the friction between slide parts of components by using force occurring in the environment used for the energy harvesting.

The projection optical instrument 40 according to the fourth modification implements the structure for precisely maintaining the position and attitude of the projection optical member by use of the bend parts 140 and employs structure with extremely small energy loss such as friction loss as described in the embodiment. Therefore, in the fourth modification, the hold member 150 and the projection optical member 120 can be oscillated in a sufficiently stable manner even in the case where the air-cooling fan 441 used for the forced cooling is employed as the flow source 440 to generate the force for causing the pressure gradient at the stator vane 410.

(5-3) Effect

As described above, in the projection optical instrument 40 according to the fourth modification, it is possible, by simple improvement, to stabilize the output through the cooling of the light source unit 110 and to provide the projection optical member 120 with stable oscillation at the same time.

(6) Fifth Modification

Figure 11:
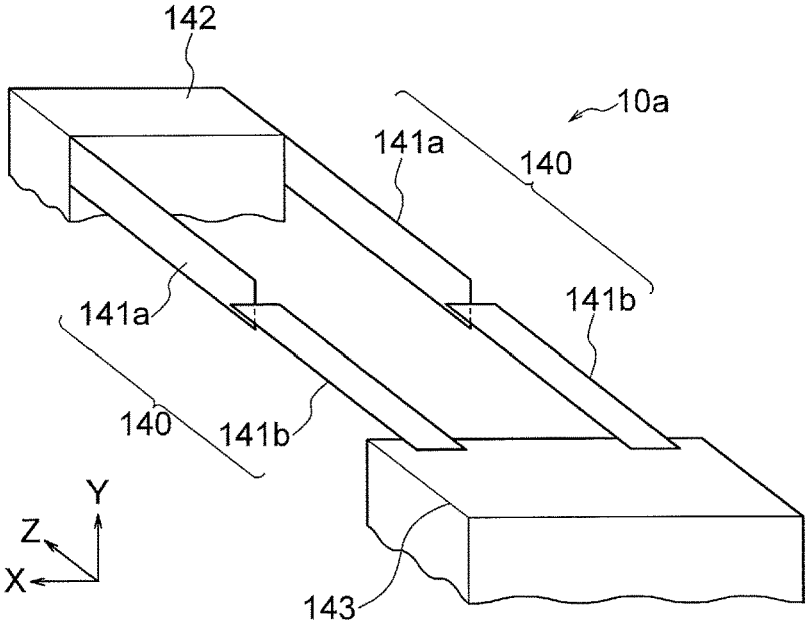
FIG. 11 is a perspective view schematically showing the configuration of a bend part of a projection optical instrument according to a fifth modification of the present invention.

FIG. 11 is a perspective view schematically showing the configuration of a bend part of a projection optical instrument 10*a* according to a fifth modification. In FIG. 11, components identical or corresponding to those shown in FIG. 1 are assigned the same reference characters as in FIG. 1.

In the example shown in FIG. 1 and FIG. 2, it is configured that the long side direction (Z-axis direction), the short side direction (Y-axis direction) and the thickness direction (X-axis direction) are common to the plurality of leaf springs 141 of the plurality of bend parts 140 and each of the bend parts 141 is capable of curving (bending) only in the Y-axis direction.

In contrast, the bend part 140 of the projection optical instrument 10*a* according to the fifth modification shown in FIG. 11 includes a first leaf spring part 141*a* and a second leaf spring part 141*b*. The first leaf spring part 141*a* and the second leaf spring part 141*b* will be explained in the fifth modification collectively as one leaf spring. Thus, the first leaf spring part 141*a* and the second leaf spring part 141*b* will be explained as parts of one leaf spring. Namely, in the fifth modification, leaf springs 141 each including two leaf spring parts 141*a* and 141*b* are employed.

The first leaf spring part 141*a* is arranged so that the long side direction is in the Z-axis direction, the short side direction is in the Y-axis direction, and the thickness direction is in the X-axis direction. The second leaf spring part 141*b* is arranged so that the long side direction is in the Z-axis direction, the short side direction is in the X-axis direction, and the thickness direction is in the Y-axis direction. As shown in FIG. 11, the first leaf spring part 141*a* and the second leaf spring part 141*b* are connected at their ends in their lengthwise direction. The first leaf spring part 141*a* is capable of bending in the X-axis direction as its thickness direction. The second leaf spring part 141*b* is capable of bending in the Y-axis direction as its thickness direction.

With such a configuration, the bend part 140 shown in FIG. 11 is capable of curving (bending) in the X-axis direction and the Y-axis direction. Except these features, the projection optical instrument 10*a* shown in FIG. 11 is equivalent to the projection optical instrument 10 according to the embodiment.

(7) Sixth Modification

Figure 16:
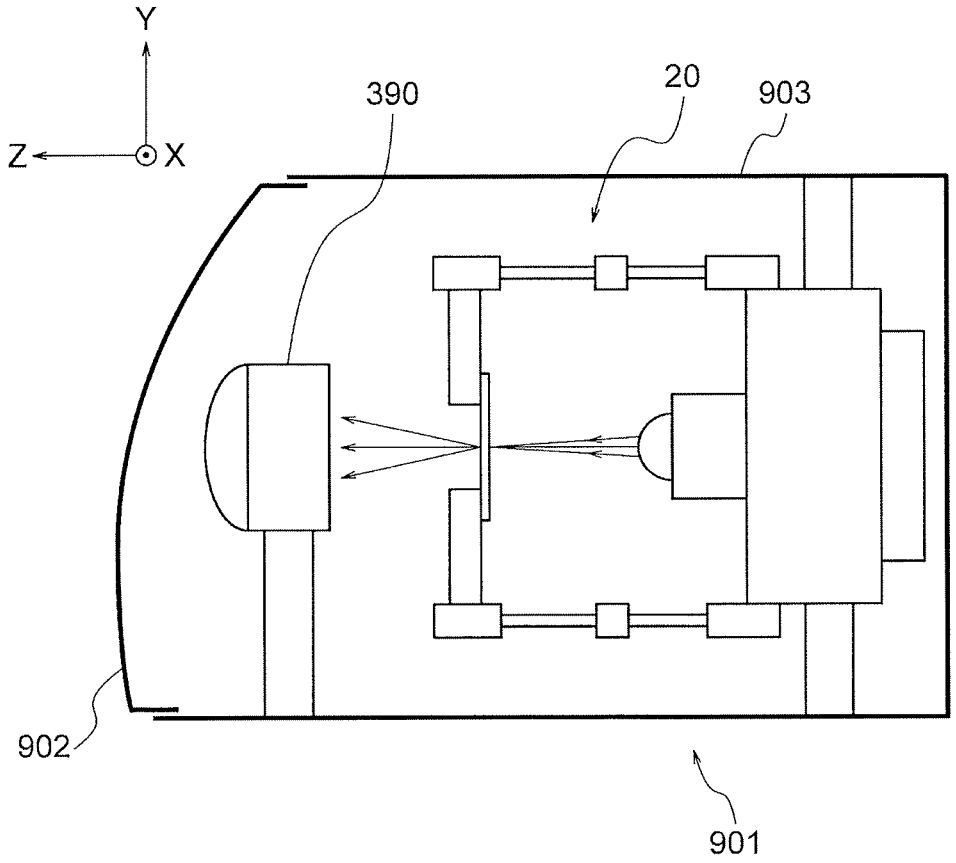
FIG. 16 is a diagram schematically showing the configuration of a headlight device according to a sixth modification of the present invention.

FIG. 16 is a diagram schematically showing the configuration of a headlight device 901 according to a sixth modification of the present invention.

In FIG. 16, a headlight device 901 equipped with the projection optical instrument 20 according to the second modification is shown as an example.

The projection optical instrument 20 is attached to a housing 903 of the headlight device 901, for example. A projection lens 390 and a cover 902 are attached to the housing 903.

The projection light L22 emitted from the projection optical instrument 20 is incident on the projection lens 390. The projection lens 390 projects the projection light L22.

The projection light L22 emitted from the projection lens 390 passes through the cover 902 and is emitted from the headlight device 901.

Incidentally, in the embodiment and its modifications described above, terms representing positional relationship between components or the shape of a component, such as "parallel" and "orthogonal", have been used in some cases. These terms indicate that a range allowing for tolerances in the manufacture, variations in the assembly, or the like is included. Therefore, when a description indicating positional relationship between components or the shape of a component is included in the claims, such a description indicates that a range allowing for tolerances in the manufacture, variations in the assembly, or the like is included.

The present invention is not limited to the embodiment and its modifications described above. It is also possible to appropriately combine some configurations employed in the embodiment and its modifications.

On the basis of the embodiment and its modifications described above, the contents of the present invention will be described below as (Appendix 1) and (Appendix 2).

Appendix 1

Appendix 1-1

A projection optical instrument comprising:

a light source unit that emits light;

a projection optical member that transforms the light emitted from the light source unit into projection light;

a support part that supports the projection optical member to be movable with respect to the light source unit in at least one direction orthogonal to an optical axis direction of the light source unit; and a vibration application unit that applies vibration to at least one of the light source unit and the projection optical member.

Appendix 1-2

The projection optical instrument according to appendix 1-1, wherein the support part includes a bend part that connects the light source unit and the projection optical member.

Appendix 1-3

The projection optical instrument according to appendix 1-1, wherein the support part includes:

a first support member by which the light source unit is supported;

a second support member by which the projection optical member is supported;

a bend part that connects the light source unit and the projection optical member via the first support member and the second support member.

Appendix 1-4

The projection optical instrument according to appendix 1-2 or 1-3, wherein the bend part includes a leaf spring that is long in the optical axis direction.

Appendix 1-5

The projection optical instrument according to any one of appendixes 1-2 to 1-4, further comprising a resonance point adjustment member attached to the bend part.

Appendix 1-6

The projection optical instrument according to any one of appendixes 1-1 to 1-5, wherein the at least one direction is a first direction orthogonal to the optical axis direction.

Appendix 1-7

The projection optical instrument according to any one of appendixes 1-1 to 1-5, wherein the support part supports the projection optical member to be movable with respect to the light source unit in a first direction orthogonal to the optical axis direction and in a second direction orthogonal to both the optical axis direction and the first direction.

Appendix 1-8

The projection optical instrument according to any one of appendixes 1-1 to 1-7, wherein the vibration application unit is a vibration transmission member that transmits external vibration occurring outside the projection optical instrument to the light source unit.

Appendix 1-9

The projection optical instrument according to any one of appendixes 1-1 to 1-7, wherein the vibration application unit is a vibration generating device that applies the vibration to the light source unit.

Appendix 1-10

The projection optical instrument according to any one of appendixes 1-1 to 1-7, wherein the vibration application unit includes:

a stator vane provided in the projection optical member; and a flow source that sends fluid towards the stator vane.

Appendix 1-11

The projection optical instrument according to any one of appendixes 1-1 to 1-10, wherein the projection optical member includes at least one of a lens and a fluorescent body.

Appendix 1-12

The projection optical instrument according to any one of appendixes 1-1 to 1-11, further comprising:

a measurement unit that measures a displacement amount of the projection optical member; and a control device that increases and decreases a light amount of the light emitted from the light source unit so as to be a light amount corresponding to the displacement amount.

Appendix 1-13

The projection optical instrument according to appendix 1-12, wherein the measurement unit includes a photodetector that detects part of the light emitted from the light source unit or part of the projection light, and the control device measures the displacement amount of the projection optical member on a basis of variation in an output value of the photodetector.

Appendix 1-14

The projection optical instrument according to appendix 1-12 or 1-13, wherein the control device previously estimates a displacement amount of an irradiation position of the projection light emitted from the projection optical member on a basis of the displacement amount of the projection optical member and performs light distribution control by increasing and decreasing the light amount of the light emitted from the light source unit so as to correspond to the estimated displacement amount.

Appendix 1-15

The projection optical instrument according to appendix 1-12 or 1-13, wherein the control device previously estimates the displacement amount of the projection optical member on a basis of a resonance vibration frequency of the bend part and periodically increases and decreases the light amount of the light emitted from the light source unit so as to correspond to the estimated displacement amount.

Appendix 1-16

The projection optical instrument according to appendix 1-12 or 1-13, wherein the control device previously estimates the displacement amount of the projection optical member on a basis of a vibration frequency of the vibration application unit and periodically increases and decreases the light amount of the light emitted from the light source unit so as to correspond to the estimated displacement amount.

Appendix 1-17

A headlight device for a vehicle, comprising the projection optical instrument according to any one of appendixes 1-1 to 1-16.

Appendix 1-18

A headlight device for a vehicle, comprising the projection optical instrument according to appendix 1-8, wherein the vibration application unit of the projection optical instrument transmits vibration of the vehicle to the light source unit as the external vibration.

Appendix 2

Appendix 2-1

A projection optical instrument comprising:

a light source unit that emits light;

a projection optical member that transforms the light emitted from the light source unit into projection light; and a support part that supports the projection optical member to be movable with respect to the light source unit in at least one direction orthogonal to an optical axis direction of the light source unit, wherein when vibration is applied to at least one of the light source unit and the projection optical member, the projection optical member accordingly vibrates with respect to the light source unit in a direction orthogonal to the optical axis direction of the light source unit.

Appendix 2-2

The projection optical instrument according to appendix 2-1, wherein the support part includes a bend part that bends in a first direction orthogonal to the optical axis direction and in a second direction orthogonal to the optical axis direction and the first direction, and thereby the bend part moves the projection optical member with respect to the light source unit, and a first spring constant of the bend part regarding the bending in the first direction and a second spring constant of the bend part regarding the bending in the second direction differ from each other.

Appendix 2-3

The projection optical instrument according to appendix 2-2, wherein the bend part is in a pillar shape.

Appendix 2-4

The projection optical instrument according to appendix 2-2, wherein the bend part includes a leaf spring that is long in the optical axis direction.

Appendix 2-5

The projection optical instrument according to appendix 2-4, wherein the leaf spring of the bend part includes a first leaf spring and a second leaf spring, a bending direction of the first leaf spring is the first direction, and a bending direction of the second leaf spring is the second direction.

Appendix 2-6

The projection optical instrument according to any one of appendixes 2-2 to 2-5, wherein the support part includes:

a first support member by which the light source unit is supported; and a second support member by which the projection optical member is supported, wherein the bend part connects the light source unit and the projection optical member via the first support member and the second support member.

Appendix 2-7

The projection optical instrument according to any one of appendixes 2-2 to 2-6, further comprising a resonance point adjustment member attached to the bend part.

Appendix 2-8

The projection optical instrument according to any one of appendixes 2-1 to 2-7, wherein the projection optical member includes a heat radiation part that reduces heat generated in the projection optical member, and the heat radiation part has an opening through which the light emitted from the light source unit passes.

Appendix 2-9

The projection optical instrument according to any one of appendixes 2-1 to 2-8, wherein the projection optical member is a lens.

Appendix 2-10

The projection optical instrument according to any one of appendixes 2-1 to 2-8, wherein the projection optical member is a fluorescent body that emits fluorescent light in response to the light emitted from the light source unit as excitation light.

Appendix 2-11

The projection optical instrument according to any one of appendixes 2-1 to 2-10, comprising a vibration application unit that applies the vibration to at least one of the light source unit and the projection optical member.

Appendix 2-12

The projection optical instrument according to appendix 2-11, wherein the vibration application unit is a vibration transmission member that transmits external vibration occurring outside the projection optical instrument to the light source unit.

Appendix 2-13

The projection optical instrument according to appendix 2-11, wherein the vibration application unit is a vibration generating device that applies the vibration to the light source unit.

Appendix 2-14

The projection optical instrument according to appendix 2-11, wherein the vibration application unit includes a vane-shaped member provided in the projection optical member, and the vane-shaped member vibrates when receiving fluid.

Appendix 2-15

The projection optical instrument according to appendix 2-14, wherein the vibration application unit includes a flow source that sends the fluid towards the vane-shaped member.

Appendix 2-16

The projection optical instrument according to any one of appendixes 2-1 to 2-15, further comprising:

a measurement unit that measures a displacement amount of the projection optical member; and a control unit that increases and decreases a light amount of the light emitted from the light source unit so as to be a light amount corresponding to the displacement amount.

Appendix 2-17

The projection optical instrument according to appendix 2-16, wherein the measurement unit includes a photodetector that detects part of the light emitted from the light source unit or part of the projection light, and the control unit measures the displacement amount of the projection optical member on a basis of variation in an output value of the photodetector.

Appendix 2-18

The projection optical instrument according to appendix 2-16 or 2-17, wherein the control unit previously estimates a displacement amount of an irradiation position of the projection light emitted from the projection optical member on a basis of the displacement amount of the projection optical member and performs light distribution control by increasing and decreasing the light amount of the light emitted from the light source unit so as to correspond to the estimated displacement amount.

Appendix 2-19

The projection optical instrument according to appendix 2-16 or 2-17, wherein the control unit previously estimates the displacement amount of the projection optical member on a basis of a resonance vibration frequency of the support part and periodically increases and decreases the light amount of the light emitted from the light source unit so as to correspond to the estimated displacement amount.

Appendix 2-20

The projection optical instrument according to appendix 2-16 or 2-17, comprising a vibration application unit that applies the vibration to at least one of the light source unit and the projection optical member, wherein the control unit previously estimates the displacement amount of the projection optical member on a basis of a vibration frequency of the vibration application unit and periodically increases and decreases the light amount of the light emitted from the light source unit so as to correspond to the estimated displacement amount.

Appendix 2-21

The projection optical instrument according to any one of appendixes 2-1 to 2-20, wherein a direction of the vibration applied to the light source unit or the projection optical member is a direction orthogonal to the optical axis direction.

Appendix 2-22

The projection optical instrument according to any one of appendixes 2-1 to 2-20, wherein directions of the vibration applied to the light source unit or the projection optical member are two directions orthogonal to the optical axis direction, the two directions being orthogonal to each other.

Appendix 2-23

A headlight device used for a vehicle, comprising the projection optical instrument according to any one of appendixes 2-1 to 2-22.

Appendix 2-24

A headlight device used for a vehicle, comprising the projection optical instrument according to appendix 2-12, wherein the vibration application unit of the projection optical instrument transmits vibration of the vehicle to the light source unit as the external vibration.

Appendix 2-25

A headlight device used for a vehicle, comprising the projection optical instrument according to appendix 2-14, wherein a flow of the fluid is an air flow caused by traveling of the vehicle.

Appendix 2-26

A headlight device used for a vehicle, comprising the projection optical instrument according to appendix 2-15, wherein the flow source guides an air flow caused by traveling of the vehicle to the vane-shaped member.

DESCRIPTION OF REFERENCE CHARACTERS

10, 10*a*, 20, 30, 40: projection optical instrument, 110, 210, 310: light source unit, 111, 211, 311: light emission source, 112, 212, 312: light source unit optical member, 113, 213, 313: light source unit housing, 120, 220: projection optical member, 130, 330: housing (first support member), 140, 140*a*, 140*b*, 340: bend part, 141, 141*a*, 141*b*: leaf spring, 142: fixation member, 143: fixation member, 144: resonance point adjustment member, 150: hold member 150 (second support member), 160: support part, 170, 270, 370, 470: vibration application unit, 410: stator vane, 420: stator vane support part, 430: heat radiation plate, 440: flow source, 450: fluid, 901: headlight device, 902: cover, 903: housing, L11, L21, L31: light (incident light), L12, L12*a*, L12*b*, L22, L32, L32*a*, L32*b*: projection light (outgoing light).

What is claimed is:

1. A projection optical instrument comprising:

a light source unit that emits light;

a projection optical member that transforms the light emitted from the light source unit into projection light; and a support part that supports the projection optical member to be movable with respect to the light source unit in at least one direction orthogonal to an optical axis direction of the light source unit, wherein when vibration is applied to at least one of the light source unit and the projection optical member, the projection optical member accordingly vibrates with respect to the light source unit in a direction orthogonal to the optical axis direction of the light source unit, the support part includes a bend part that bends in a first direction orthogonal to the optical axis direction and in a second direction orthogonal to the optical axis direction and the first direction, and thereby the bend part moves the projection optical member with respect to the light source unit, and a first spring constant of the bend part regarding the bending in the first direction and a second spring constant of the bend part regarding the bending in the second direction differ from each other.

2. The projection optical instrument according to claim 1, wherein the bend part is in a pillar shape.

3. The projection optical instrument according to claim 1, wherein the bend part includes a leaf spring that is long in the optical axis direction.

4. The projection optical instrument according to claim 3, wherein the leaf spring of the bend part includes a first leaf spring and a second leaf spring, a bending direction of the first leaf spring is the first direction, and a bending direction of the second leaf spring is the second direction.

5. The projection optical instrument according to claim 1, wherein the projection optical member includes a heat radiation part that reduces heat generated in the projection optical member, and the heat radiation part has an opening through which the light emitted from the light source unit passes.

6. The projection optical instrument according to claim 1, wherein the projection optical member is a fluorescent body that emits fluorescent light in response to the light emitted from the light source unit as excitation light.

7. The projection optical instrument according to claim 1, further comprising a vibration application unit that applies the vibration to at least one of the light source unit and the projection optical member.

8. The projection optical instrument according to claim 1, wherein a direction of the vibration applied to the light source unit or the projection optical member is a direction orthogonal to the optical axis direction.

9. The projection optical instrument according to claim 1, wherein directions of the vibration applied to the light source unit or the projection optical member are two directions orthogonal to the optical axis direction, the two directions being orthogonal to each other.

10. A headlight device used for a vehicle, comprising the projection optical instrument according to claim 1.

* * * * *